US010220997B2

(12) United States Patent
Oakes et al.

(10) Patent No.: US 10,220,997 B2
(45) Date of Patent: Mar. 5, 2019

(54) CUTLERY DISPENSER AND RELATED METHODS

(71) Applicant: GPCP IP Holdings LLC, Atlanta, GA (US)

(72) Inventors: Shawn A. Oakes, Ripon, WI (US); Abby C. Case, Green Bay, WI (US)

(73) Assignee: GPCP IP HOLDINGS LLC, Atlanta, GA (US)

( * ) Notice: Subject to any disclaimer, the term of this patent is extended or adjusted under 35 U.S.C. 154(b) by 0 days.

(21) Appl. No.: 14/336,733

(22) Filed: Jul. 21, 2014

(65) Prior Publication Data

US 2015/0028046 A1 Jan. 29, 2015

Related U.S. Application Data

(60) Provisional application No. 61/858,199, filed on Jul. 25, 2013.

(51) Int. Cl.
*B65D 75/42* (2006.01)
*A47F 10/06* (2006.01)

(52) U.S. Cl.
CPC ..... *B65D 75/42* (2013.01); *A47F 10/06* (2013.01)

(58) Field of Classification Search
CPC ..... B65D 75/42; A47F 1/12; A47F 2001/103
USPC ..... 221/1, 26, 32
See application file for complete search history.

(56) References Cited

U.S. PATENT DOCUMENTS 46,832 A 3/1865 Thorne
592,105 A 10/1897 Barnes
D32,913 S 6/1900 Graf
703,718 A 7/1902 Camman
716,058 A 12/1902 Lang et al.
925,485 A 6/1909 Lafler
999,837 A 8/1911 Morris et al.
1,053,387 A 2/1913 Hawley
(Continued)

FOREIGN PATENT DOCUMENTS

CA 2545745 A1 11/2006
CN 2865478 Y 2/2007
(Continued)

OTHER PUBLICATIONS

International Searching Authority, "International Search Report and Written Opinion for PCT/US2014/047463", dated Nov. 26, 2014, 22 pages, Korean Intellectual Property Office, South Korea.
(Continued)

*Primary Examiner* — Rakesh Kumar

(57) ABSTRACT

The present disclosure provides a cutlery dispenser for dispensing wrapped cutlery. The cutlery dispenser may include a wrapped cutlery band comprising a plurality of cutlery packets separably connected to one another in a serial manner. The cutlery dispenser also may include a nozzle assembly configured to allow the cutlery packets to be dispensed therethrough. The present disclosure also provides a method for dispensing wrapped cutlery. The method may include the step of providing a cutlery dispenser comprising a nozzle assembly and a wrapped cutlery band, wherein the wrapped cutlery band comprises a plurality of cutlery packets separably connected to one another in a serial manner. The method also may include the step of dispensing the cutlery packets through the nozzle assembly.

49 Claims, 14 Drawing Sheets

(56) References Cited

U.S. PATENT DOCUMENTS 1,146,447 A 7/1915 Prommel
1,182,793 A 5/1916 Richardson
1,259,927 A 3/1918 Swift
1,261,835 A 4/1918 Martin
1,353,109 A 9/1920 Carr
1,355,583 A 10/1920 Zeidler et al.
1,482,071 A 1/1924 Duff et al.
1,497,585 A 6/1924 Poole
1,504,098 A 8/1924 Cathey
1,546,077 A 7/1925 Hunter et al.
1,547,151 A 7/1925 Watling
1,560,938 A 11/1925 Lund
1,577,302 A 3/1926 Schultz
1,610,001 A 12/1926 Foster
1,635,386 A 7/1927 Pierson
1,675,510 A 7/1928 Nolan
1,767,634 A 6/1930 Weiss
1,821,377 A 3/1931 Cusick
1,886,378 A 11/1932 George
1,936,057 A 11/1933 Hodge
2,052,505 A 8/1936 Vetrosky
2,053,828 A 9/1936 Harper
2,078,984 A 5/1937 Williamson
2,089,378 A 8/1937 Jenkin
2,110,189 A 3/1938 Zeidler
2,141,684 A 12/1938 Diemer
2,149,098 A 2/1939 Phinney
2,149,099 A 2/1939 Phinney et al.
2,160,374 A 5/1939 Veillette
2,184,029 A 12/1939 Wicklund
2,188,573 A 1/1940 Longo
D119,760 S 4/1940 Kopp
2,207,528 A 7/1940 Witt
2,223,347 A 12/1940 Axthelm
2,239,196 A 4/1941 Lunvik
2,246,852 A 6/1941 Kale
2,260,596 A 10/1941 Young
2,268,596 A 1/1942 Jerum
2,268,873 A * 1/1942 Hopkins ..... A47F 1/10 221/242
2,328,486 A 8/1943 Painter
2,340,561 A 2/1944 Renfro
2,497,718 A 1/1945 Earley et al.
2,401,534 A 6/1946 Welch
2,421,782 A 6/1947 Gibbs et al.
2,427,321 A 9/1947 Casey et al.
2,431,121 A 11/1947 Hunter
2,433,736 A 12/1947 Carew
2,445,026 A 7/1948 Frank
2,472,051 A 5/1949 Testi
2,503,741 A 4/1950 Johnson
2,506,717 A * 5/1950 Merle ..... A47F 1/06 221/131
2,526,136 A 10/1950 Holzknecht
2,571,668 A 10/1951 Booth et al.
2,577,344 A 12/1951 Masure
2,624,093 A 1/1953 Hatch et al.
2,635,025 A 4/1953 Ziska
2,646,874 A 7/1953 Testi
2,651,093 A 9/1953 Lynch
2,671,555 A 3/1954 Shnitzler
2,692,691 A 10/1954 Harriss et al.
2,695,125 A 11/1954 Bowen
2,965,262 A 9/1955 Du Bois
2,752,678 A 7/1956 Welch
2,758,710 A * 8/1956 Egmont ..... B65D 75/42 206/409
2,771,214 A 11/1956 Lefebvre
2,800,013 A 7/1957 George
2,806,634 A 9/1957 Baumgartner
2,824,369 A 2/1958 Welch
2,843,909 A 7/1958 Eilertsen
2,845,679 A 8/1958 Baruch
2,857,645 A 10/1958 Vogelsang
2,868,344 A 1/1959 Shields
2,870,505 A 1/1959 Hawie
2,877,490 A 3/1959 Greninger
2,877,926 A 3/1959 Abbe
2,880,907 A 4/1959 Mainers
2,881,247 A 4/1959 Levine et al.
2,889,076 A 6/1959 Van Schie
2,907,512 A 10/1959 Leone
2,911,127 A 11/1959 Driss et al.
2,924,357 A 2/1960 Kingsley et al.
2,946,431 A 7/1960 Nissen
2,946,481 A 7/1960 Carew
2,953,170 A 9/1960 Bush
2,954,948 A 10/1960 Johnson
3,021,919 A 2/1962 Peters
3,037,257 A 6/1962 Girodet
3,048,268 A 8/1962 Rocchi et al.
3,052,006 A 9/1962 Jonas
3,083,879 A 4/1963 Coleman
3,095,114 A 6/1963 Tobias
3,100,842 A 8/1963 Tellefsen
3,114,475 A 12/1963 Etes
3,115,989 A 12/1963 Strang
3,116,152 A 12/1963 Smith
3,132,765 A 5/1964 Florendo
3,146,908 A 9/1964 Perri et al.
3,163,327 A 12/1964 Maxwell
3,180,489 A 4/1965 McGinn
3,182,345 A 5/1965 Smith
3,191,802 A 6/1965 Lasting
3,217,954 A 11/1965 Grant et al.
3,263,860 A 8/1966 Haas
3,279,652 A 10/1966 Willvonseder
3,300,087 A 1/1967 Kuypers
3,310,271 A 3/1967 King
3,313,452 A 4/1967 Katz
3,325,050 A 6/1967 Wanamaker
3,334,784 A 8/1967 Morrison
3,338,471 A 8/1967 De Good
3,371,821 A 3/1968 Abood et al.
3,383,018 A 5/1968 Grimsley
3,400,435 A 9/1968 Akesson-Rydin
3,402,441 A 9/1968 Woskin
3,407,927 A 10/1968 Jones
3,408,708 A 11/1968 Hawie
3,426,941 A 2/1969 Hovekamp
3,435,491 A 4/1969 Shears
3,472,421 A 10/1969 Albert
3,499,538 A 3/1970 Sherard
3,549,006 A 12/1970 Meierhofer
3,558,006 A 1/1971 Redmond et al.
3,587,922 A 6/1971 Oriti
3,593,908 A 7/1971 Desmond et al.
3,654,396 A 4/1972 Biezeveld
3,680,736 A 8/1972 Wiessmann
3,709,403 A 1/1973 Harriman
3,710,535 A 1/1973 Walter
3,741,410 A 6/1973 Henschke et al.
3,747,803 A 7/1973 Zoepf et al.
3,786,959 A 1/1974 Greb et al.
3,851,762 A 12/1974 Liblick
3,861,563 A 1/1975 Lisbin
3,862,702 A 1/1975 Johnson
3,897,886 A 8/1975 Franklin
3,932,978 A 1/1976 Kinney
3,944,128 A 3/1976 Hogan et al.
3,972,118 A 8/1976 Richard
3,987,901 A 10/1976 Dullinger
3,998,238 A 12/1976 Nigro
4,005,801 A 2/1977 Musser et al.
4,043,203 A 8/1977 Montesi
4,048,915 A 9/1977 Martin
4,091,915 A 5/1978 Claasen
4,120,662 A 10/1978 Fosslien
4,134,519 A 1/1979 Barnett et al.
4,146,123 A 3/1979 Cottrell
4,236,553 A * 12/1980 Reichenberger ..... B67D 1/1238 141/198
4,271,999 A 6/1981 Stravitz
4,288,003 A 9/1981 Fries

(56) References Cited

U.S. PATENT DOCUMENTS 4,308,974 A 1/1982 Jones
4,317,284 A 3/1982 Prindle
4,382,514 A 5/1983 Williams et al.
4,387,831 A 6/1983 Mcnally
4,489,854 A 12/1984 Wenkman et al.
4,524,512 A 6/1985 Formo et al.
4,570,536 A 2/1986 Dodd
4,571,773 A 2/1986 Yuda
4,574,423 A 3/1986 Ito et al.
D284,442 S 7/1986 Chan
4,601,386 A 7/1986 Antonello
4,610,087 A 9/1986 Mickelson et al.
4,614,004 A 9/1986 Oshida
4,624,616 A 11/1986 Freese et al.
4,638,921 A 1/1987 Sigl et al.
4,648,530 A * 3/1987 Granger ..... A47K 10/34 221/155
4,662,536 A 5/1987 Powers
4,666,037 A 5/1987 Weissman et al.
4,666,060 A 5/1987 Bouldin
4,691,811 A 9/1987 Arakawa et al.
4,697,673 A 10/1987 Omata
4,707,251 A 11/1987 Jenkins et al.
4,715,514 A 12/1987 Vidondo
4,735,342 A * 4/1988 Goldstein ..... B65D 85/672 206/394
4,789,064 A 12/1988 Segal
4,793,539 A * 12/1988 Haenni ..... A47F 9/042 221/63
4,798,319 A * 1/1989 James, Jr. ..... A63B 47/001 224/251
4,807,753 A 2/1989 Goldstein
4,835,864 A 6/1989 Tang
4,863,033 A 9/1989 Buj
4,884,718 A 12/1989 Leahy
D305,709 S 1/1990 Blignaut
4,896,792 A 1/1990 Marchand
4,915,578 A 4/1990 Becker
4,921,106 A 5/1990 Spatafora et al.
4,950,120 A 8/1990 Barnes
4,953,781 A * 9/1990 Bryan ..... B65D 5/744 229/123.2
4,961,684 A 10/1990 Provan et al.
4,963,072 A 10/1990 Miley et al.
RE33,447 E 11/1990 Rosman
4,973,037 A 11/1990 Holbrook
4,986,442 A 1/1991 Hinterreiter
4,989,730 A 2/1991 Lemoine et al.
4,995,154 A 2/1991 Bamber
5,012,927 A 5/1991 Borst et al.
D318,600 S 7/1991 Lillelund et al.
5,054,640 A 10/1991 Tucker et al.
5,054,649 A 10/1991 Lemaire
5,064,093 A 12/1991 Davis et al.
5,080,257 A 1/1992 Carnisio
5,125,566 A * 6/1992 Deiger ..... B65D 5/2033 229/103.11
5,127,546 A 7/1992 Chen
5,131,586 A 7/1992 Capy
5,156,266 A 10/1992 Sykora et al.
5,161,268 A 11/1992 Harrow
5,161,691 A 11/1992 Vulliez
5,176,494 A 1/1993 Nigrelli et al.
5,191,997 A 3/1993 Squitieri
5,199,756 A 4/1993 Bartlett et al.
5,211,267 A 5/1993 Clark
D336,047 S 6/1993 Kim
5,249,705 A 10/1993 Gates
5,263,596 A 11/1993 Williams
D342,648 S 12/1993 Cautereels et al.
5,269,397 A 12/1993 Kawamoto et al.
5,288,361 A 2/1994 Konno
5,305,875 A 4/1994 Meyer et al.
5,325,992 A * 7/1994 Koller ..... A47F 13/085 221/33
5,327,650 A 7/1994 Rojas
D351,085 S 10/1994 Schmidt
5,353,935 A 10/1994 Yeager et al.
5,364,016 A 11/1994 Capy et al.
5,413,317 A 5/1995 Spoerre
D362,160 S 9/1995 Brabeck et al.
5,449,054 A 9/1995 Wiese et al.
5,460,252 A 10/1995 Kosugi et al.
5,469,688 A 11/1995 Dunbar et al.
5,479,708 A 1/1996 Thomas
5,496,599 A 3/1996 Schwartz et al.
5,497,863 A 3/1996 Schmidt et al.
5,509,522 A 4/1996 Laidlaw
5,518,149 A 5/1996 Lotspeich et al.
5,542,508 A 8/1996 Van Erden et al.
5,564,594 A 10/1996 Monfredo
5,579,910 A 12/1996 Bennett
5,586,685 A 12/1996 Dorner et al.
5,590,472 A 1/1997 Yaakov
5,605,208 A 2/1997 Friedrichsen et al.
5,660,252 A 8/1997 Lafon
5,762,211 A 6/1998 Ensign
5,845,403 A 12/1998 Nivin
5,853,092 A 12/1998 Goodman et al.
5,904,250 A * 5/1999 De Schutter ..... B65D 71/00 206/553
5,921,408 A 7/1999 Groenwold et al.
5,933,918 A 8/1999 Wallays
5,950,842 A 9/1999 Bauer
5,961,021 A 10/1999 Koike et al.
D420,887 S 2/2000 Chen
6,021,919 A * 2/2000 Kelly ..... A61B 19/045 221/155
6,023,908 A 2/2000 Vetsch
6,023,913 A 2/2000 Gray et al.
D422,431 S 4/2000 Goins
6,047,830 A 4/2000 Chang
6,062,424 A 5/2000 Simile-Gravina et al.
6,073,795 A 6/2000 Longstreth
6,085,916 A 7/2000 Kovacevic et al.
6,098,379 A 8/2000 Spatafora et al.
6,115,921 A 9/2000 Garneau
6,134,790 A 10/2000 Watson
6,202,891 B1 3/2001 Mark
6,226,845 B1 5/2001 Fink
6,250,495 B1 6/2001 Bando
6,250,498 B1 6/2001 Lovejoy
6,289,889 B1 9/2001 Bell et al.
6,298,960 B1 10/2001 Derr
6,336,568 B1 1/2002 Tucker et al.
6,378,729 B1 4/2002 Kodama
D458,070 S 6/2002 Bennett et al.
6,399,079 B1 6/2002 Mehta et al.
6,412,398 B1 7/2002 Norcross et al.
6,412,652 B1 7/2002 Woram et al.
6,415,465 B1 7/2002 Harrow
6,575,313 B1 6/2003 Chen
6,626,633 B2 9/2003 Jendzurski et al.
6,651,841 B2 11/2003 Tsuchida
6,749,074 B1 6/2004 Hileman et al.
D492,549 S 7/2004 Welch
D493,337 S 7/2004 Welch
6,763,972 B2 7/2004 Graupner
6,786,357 B2 7/2004 Renard
6,786,359 B1 9/2004 Schroeder
6,832,694 B2 12/2004 Goeking et al.
6,832,698 B1 12/2004 Dybul
6,837,028 B1 1/2005 Miano et al.
6,840,353 B2 1/2005 Arisaka
6,840,420 B1 1/2005 Hudson
6,863,173 B2 3/2005 Bennett
6,880,211 B2 4/2005 Jackson et al.
6,895,672 B2 5/2005 Conforti
6,945,427 B2 9/2005 Hieb
6,951,266 B2 10/2005 Tournier
6,972,033 B2 12/2005 McNicholas
6,976,348 B1 12/2005 Miano et al.

(56) References Cited

U.S. PATENT DOCUMENTS 7,013,568 B2 3/2006 Schmidt
7,076,932 B2 7/2006 Rubin
7,090,455 B2 8/2006 Lamb
7,111,369 B2 9/2006 Ho
D533,034 S 12/2006 Wasserman
7,156,220 B2 1/2007 Olson et al.
D536,222 S 2/2007 Heiberg et al.
7,204,406 B2 4/2007 Bone et al.
7,210,279 B1 5/2007 Ahmed et al.
7,237,700 B2 7/2007 Bulovic
7,249,793 B1 7/2007 Jabr et al.
7,258,233 B2 8/2007 Lee et al.
7,322,172 B2 1/2008 Hoffman et al.
7,325,376 B1 2/2008 DiNello et al.
D564,819 S 3/2008 Fosburg et al.
7,412,808 B2 8/2008 Lavi
7,434,692 B2 10/2008 Ginsberg et al.
D591,104 S 4/2009 Oakes
7,513,089 B2 4/2009 Rubin
7,516,831 B2 4/2009 Chang
7,520,247 B2 4/2009 Rutledge
7,669,256 B2 3/2010 Harrow
7,716,842 B2 5/2010 Sumner-Trivisani et al.
7,731,899 B2 6/2010 Telmer et al.
7,819,234 B2 10/2010 Herzog
7,856,722 B2 12/2010 Lago-Arenas
D631,337 S 1/2011 Prevost
7,905,370 B2 * 3/2011 Leonetti ..... A47F 1/082 221/1
8,070,013 B2 12/2011 Reinsel et al.
8,083,058 B2 12/2011 Marcinkowski et al.
8,083,097 B2 12/2011 Kaufman et al.
8,152,004 B2 4/2012 Smith et al.
8,210,364 B2 * 7/2012 Smith ..... A47F 1/10 211/70.7
8,272,533 B1 * 9/2012 D'Amelia ..... A47F 1/10 221/172
8,296,957 B2 10/2012 Muehlemann
8,297,473 B2 10/2012 Smith
8,302,269 B2 11/2012 Pitman
8,360,273 B2 1/2013 Reinsel et al.
8,381,957 B2 * 2/2013 Burli ..... A47F 13/085 225/14
8,444,006 B2 5/2013 Dixon
8,480,954 B2 7/2013 Telmer et al.
8,776,379 B2 7/2014 Walters et al.
8,839,522 B2 9/2014 Walters et al.
8,844,798 B2 9/2014 Linkel
9,439,518 B2 9/2016 Oakes
9,560,920 B2 2/2017 Oakes
D783,303 S 4/2017 Roche
D788,485 S 6/2017 Greenwald et al.
2001/0007308 A1 7/2001 Glassman et al.
2001/0025856 A1 10/2001 Lefevre Du Grosriez et al.
2002/0112445 A1 8/2002 Scaduto
2002/0170918 A1 * 11/2002 Solovay ..... A61F 15/002 221/73
2003/0015824 A1 1/2003 Forbes et al.
2003/0098344 A1 5/2003 Blake et al.
2004/0045398 A1 3/2004 Hayashi
2004/0045860 A1 * 3/2004 Edgerly ..... B65D 33/008 206/504
2004/0089670 A1 5/2004 Goeking et al.
2004/0237311 A1 12/2004 Brown et al.
2005/0035136 A1 * 2/2005 Dathe ..... A47F 1/04 221/71
2005/0082307 A1 4/2005 Tucker
2005/0116482 A1 6/2005 Harris et al.
2005/0155186 A1 7/2005 McGuyer et al.
2005/0155229 A1 7/2005 Lee
2005/0211722 A1 9/2005 Runnels
2005/0252057 A1 11/2005 Lavi
2006/0000190 A1 1/2006 Behnke et al.
2006/0042986 A1 3/2006 Simkowski et al.
2006/0053638 A1 3/2006 Sumner-Trivisani et al.
2006/0074390 A1 * 4/2006 Price ..... A61F 15/001 604/357
2006/0218795 A1 10/2006 Santa Cruz et al.
2006/0249531 A1 11/2006 Litchfield et al.
2007/0035943 A1 2/2007 Wang
2007/0108141 A1 5/2007 Smith et al.
2007/0131705 A1 6/2007 Behravesh et al.
2007/0193968 A1 8/2007 Smith et al.
2007/0214650 A1 9/2007 Tomazini
2007/0250391 A1 10/2007 Prade et al.
2008/0118609 A1 5/2008 Harlfinger et al.
2008/0121650 A1 5/2008 Smith
2008/0128445 A1 6/2008 Huang et al.
2009/0194557 A1 8/2009 Van Deursen
2010/0084418 A1 4/2010 Reinsel et al.
2010/0147869 A1 6/2010 Iliffe et al.
2010/0170915 A1 7/2010 Reinsel et al.
2010/0264159 A1 * 10/2010 Gordon ..... A47K 10/16 221/46
2011/0180562 A1 7/2011 Reinsel et al.
2011/0226797 A1 9/2011 Reinsel et al.
2011/0296693 A1 12/2011 Oakes
2012/0036724 A1 2/2012 Walters
2012/0047744 A1 3/2012 Walters
2012/0080444 A1 * 4/2012 Smith ..... A47F 1/10 221/208
2012/0110746 A1 5/2012 Serrano et al.
2012/0145734 A1 6/2012 Walters
2012/0145735 A1 6/2012 Erickson et al.
2012/0145736 A1 6/2012 Walters et al.
2013/0032609 A1 2/2013 Righetti et al.
2013/0043272 A1 2/2013 Oakes
2013/0126548 A1 * 5/2013 Pourian ..... B65D 83/0472 221/70
2013/0134211 A1 5/2013 Linkel
2013/0152406 A1 6/2013 McFarland
2013/0193157 A1 8/2013 Jongen et al.
2013/0306717 A1 * 11/2013 Fitzwater ..... B65D 5/563 229/125.15
2014/0069930 A1 3/2014 Oakes
2014/0117036 A1 5/2014 Smith et al.
2014/0191024 A1 7/2014 Wnek et al.
2014/0217112 A1 8/2014 Young et al.
2014/0299656 A1 10/2014 Wintermute
2014/0312048 A1 * 10/2014 Cojocaru ..... A47K 10/38 221/45
2014/0312049 A1 * 10/2014 Glenn ..... A47K 10/426 221/63
2015/0001235 A9 1/2015 Smith
2015/0028045 A1 * 1/2015 Oakes ..... B65D 75/42 221/1
2015/0028046 A1 * 1/2015 Oakes ..... B65D 75/42 221/1
2015/0041363 A1 2/2015 Freeman et al.
2015/0041484 A1 2/2015 Oakes
2015/0048108 A1 2/2015 Borke
2015/0289679 A1 * 10/2015 Oakes ..... A47F 1/125 221/1

FOREIGN PATENT DOCUMENTS

CN 101495015 A 7/2009
DE 7033238 U 11/1970
DE 7127677 11/1971
DE 3151268 A1 7/1983
DE 4139938 A1 6/1993
DE 202005013647 U1 7/2006
EP 0257109 A1 8/1986
EP 0286538 A1 10/1988
EP 0856272 A3 1/1999
EP 1022107 A1 7/2000
EP 1217923 B1 9/2003
EP 1358827 A2 11/2003
EP 1213985 B1 6/2004
EP 1514497 A1 3/2005
EP 1719438 A1 11/2006
EP 1864596 A2 12/2007

(56) References Cited

FOREIGN PATENT DOCUMENTS

| | | | | | |
|---|---|---|---|---|---|
| FR | 2889507 | A1 | | 2/2007 | |
| JP | H06121727 | A | | 5/1994 | |
| JP | 08011934 | A | * | 1/1996 | ..... B65D 77/245 |
| JP | 08011934 | A | | 1/1996 | |
| JP | 08011934 | A | * | 1/1996 | |
| JP | 08-047440 | | | 2/1996 | |
| JP | 3042582 | U | | 10/1997 | |
| JP | 2001354214 | A | | 12/2001 | |
| JP | 2004261336 | A | | 9/2004 | |
| JP | 2007319493 | A | | 12/2007 | |
| KR | 20-1991-0008085 | | | 10/1991 | |
| KR | 10-2009-0071515 | A | | 7/2009 | |
| KR | 100954569 | B1 | | 4/2010 | |
| TW | M287639 | U | | 2/2006 | |
| TW | M293720 | U | | 7/2006 | |
| WO | 2004028309 | A1 | | 4/2004 | |
| WO | 2007049982 | A1 | | 5/2007 | |
| WO | 2009137367 | A2 | | 11/2009 | |

OTHER PUBLICATIONS

International Searching Authority, "International Search Report and Written Opinion for PCT/US2014/050166", dated Nov. 20, 2014, 11 pages, Korean Intellectual Property Office, South Korea.
International Searching Authority, "International Search Report and Written Opinion for PCT/US2014/050169", dated Jan. 9, 2015, 11 pages, Korean Intellectual Property Office, South Korea.
International Searching Authority, "International Search Report and Written Opinion for PCT/US2014/051632", dated Dec. 3, 2014, 9 pages, Korean Intellectual Property Office, South Korea.
International Searching Authority, "International Search Report and Written Opinion for PCT/US2014/051639", dated Dec. 9, 2014, 9 pages, Korean Intellectual Property Office, South Korea.
Peel Adhesion for Single Coated Pressure-Sensitive Tapes 180 Angle, Aug. 1989, pp. 21-22.
Tack Rolling Ball, Aug. 1989, pp. 29-30.
Holding Power of Pressure-Sensitive Tape, Aug. 1989, pp. 31-33.
European Search Report for 060009258.2, dated Jul. 24, 2006, five pages, Munich, Germany.
International Search Report and Written Opinion for PCT/US2011/044931, dated Feb. 28, 2012.
International Search Report and Written Opinion for PCT/US2011/044934, dated Mar. 6, 2012.
International Search Report and Written Opinion for PCT/US2011/064057, dated Feb. 29, 2012.
PCT International Search Report and Written Opinion PCT/US2007/083752, dated Mar. 11, 2008, 10 pages.
PCT International Search Report and Written Opinion PCT/US2007/083922 dated Nov. 17, 2008, 10 pages.
Supplementary European Search Report for EP 11 79 3088 dated Sep. 25, 2013.
European Search Report for EP 08 014 387.8, dated Nov. 11, 2008, four pages, European Patent Office, Munich, Germany.
International Search Report and Written Opinion for PCT/US2011/058329; dated Feb. 29, 2012.
International Search Report and Written Opinion for PCT/US2011/058767, dated Feb. 29, 2012.
International Search Report and Written Opinion for PCT/US2009/059915, dated Feb. 3, 2010, 13 pages, European Patent Office, Munich, Germany.
International Search Report and Written Opinion for PCT/US2010/000051, dated Aug. 16, 2010, 6 pages.

* cited by examiner

CUTLERY DISPENSER AND RELATED METHODS

CROSS-REFERENCE TO RELATED APPLICATIONS

This application claims the benefit of U.S. Provisional Application No. 61/858,199, filed on Jul. 25, 2013, which is incorporated herein by reference in its entirety.

FIELD OF THE DISCLOSURE

The present disclosure relates generally to disposable cutlery and more particularly to a cutlery dispenser and related methods for dispensing wrapped disposable cutlery.

BACKGROUND OF THE DISCLOSURE

Disposable cutlery may be provided as a less expensive alternative to reusable cutlery, for example, at eating facilities or social gatherings where it is undesirable or cost prohibitive to clean the cutlery for reuse. However, providing disposable cutlery may present a number of potential drawbacks related to the manner in which the cutlery is provided.

Certain eating facilities may provide disposable cutlery in loose form within open-air bins or similar containers in which all patrons place their hands to grasp and retrieve a fork, spoon, knife, or spork. Open-air bins are relatively unhygienic, however, and may facilitate transmission of bacteria and the like from one patron to the cutlery and ultimately to another patron. This concern may be partially addressed by individually wrapping the cutlery utensils in disposable packaging, although bacteria still may be transmitted via patron contact with the packaging when selecting cutlery from the bins. The use of open-air bins also may result in some patrons taking more cutlery than necessary, either intentionally or unintentionally, which increases the overall cost of providing the cutlery. For these and other reasons, it may be desirable to provide disposable cutlery in a manner other than from open-air bins.

The above-noted drawbacks may be addressed by dispensing disposable cutlery from enclosed dispensers configured to contain a large supply of cutlery utensils and to dispense the utensils one at a time to each patron. The cutlery may be provided in loose or bundled form in a shipping container, removed from the container, and then loaded into a compartment of the dispenser for later dispensing therefrom. In this manner, the loading of the dispenser may be a time consuming and tedious task, particularly for a high-volume location, potentially undermining the desirability of dispensing the disposable cutlery from a dispenser. Once loaded into the dispenser, the cutlery utensils may be dispensed one at a time to patrons by operation of a lever arm assembly, a rotating belt assembly, a gear assembly, or another dispensing mechanism. The mechanics of these dispensing mechanisms may be relatively complex, and thus the dispenser may be subject to various forms of malfunction, such as jamming during an attempted dispense. Moreover, certain dispensing mechanisms may have a tendency to unintentionally dispense more than one utensil at a time, defeating one of the potential advantages of using a cutlery dispenser—reducing the cost associated with patrons taking more cutlery than necessary. Further, due to their often complex and cumbersome designs, cutlery dispensers may occupy a large amount of space in an already crowded eating facility, which space could otherwise be used for alternative purposes.

There is thus a desire for an improved cutlery dispenser and related method for dispensing disposable cutlery to address one or more of the potential drawbacks discussed above.

SUMMARY OF THE DISCLOSURE

In one aspect, the present disclosure provides a cutlery dispenser for dispensing wrapped cutlery. The cutlery dispenser may include a wrapped cutlery band comprising a plurality of cutlery packets separably connected to one another in a serial manner. The cutlery dispenser also may include a nozzle assembly configured to allow the cutlery packets to be dispensed therethrough.

In another aspect, the present disclosure provides a method for dispensing wrapped cutlery. The method may include the step of providing a cutlery dispenser comprising a nozzle assembly and a wrapped cutlery band, wherein the wrapped cutlery band comprises a plurality of cutlery packets separably connected to one another in a serial manner. The method also may include the step of dispensing the cutlery packets through the nozzle assembly.

In still another aspect, the present disclosure provides a nozzle assembly for dispensing wrapped cutlery. The nozzle assembly may include a nozzle configured to allow a wrapped cutlery band to be dispensed therethrough, the wrapped cutlery band including a plurality of cutlery packets separably connected to one another in a serial manner. The nozzle may define an orifice extending therethrough and configured to expand to allow the cutlery packets to be pulled therethrough.

In another aspect, the present disclosure provides a cutlery dispenser for dispensing wrapped cutlery. The cutlery dispenser may include a case configured to move from a closed configuration into an open configuration. The cutlery dispenser also may include a wrapped cutlery band disposed within the case and configured to be dispensed therefrom when the case is in the closed configuration, the wrapped cutlery band comprising a plurality of cutlery packets separably connected to one another in a serial manner.

In still another aspect, the present disclosure provides a nozzle assembly for dispensing wrapped cutlery. The nozzle assembly may include a nozzle configured to allow a wrapped cutlery band to be dispensed therethrough, the wrapped cutlery band including a plurality of cutlery packets separably connected to one another in a serial manner. The nozzle may include a first nozzle portion and a second nozzle portion separate from the first nozzle portion. The first nozzle portion and the second nozzle portion may be configured to separate to allow the cutlery packets to be dispensed therebetween.

These and other aspects and improvements of the present disclosure will become apparent to one of ordinary skill in the art upon review of the following detailed description when taken in conjunction with the several drawings and the appended claims.

BRIEF DESCRIPTION OF THE DRAWINGS

The detailed description is set forth with reference to the accompanying drawings illustrating example embodiments of the disclosure, in which the use of the same reference numerals indicates similar or identical items. Certain embodiments may include elements and/or components other than those illustrated in the drawings, and some elements and/or components may not be present in certain embodiments.

DETAILED DESCRIPTION

Figure 1A:
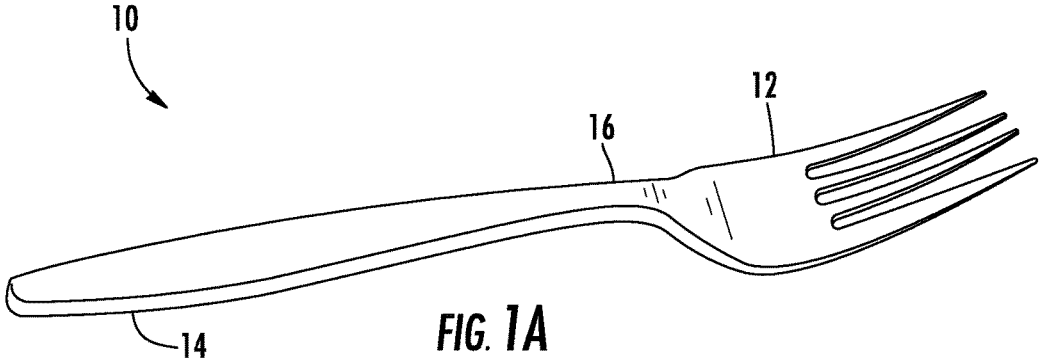
FIG. 1A is a perspective view of an example disposable cutlery utensil in accordance with one or more embodiments of the disclosure.

The present disclosure includes example embodiments of cutlery dispensers and related methods for dispensing disposable cutlery to address one or more of the drawbacks discussed above. Reference is made herein to the accompanying drawings illustrating the example embodiments of the disclosure, in which the use of the same reference numerals indicates similar or identical items. Throughout the disclosure, depending on the context, singular and plural terminology may be used interchangeably.

Figure 1B:
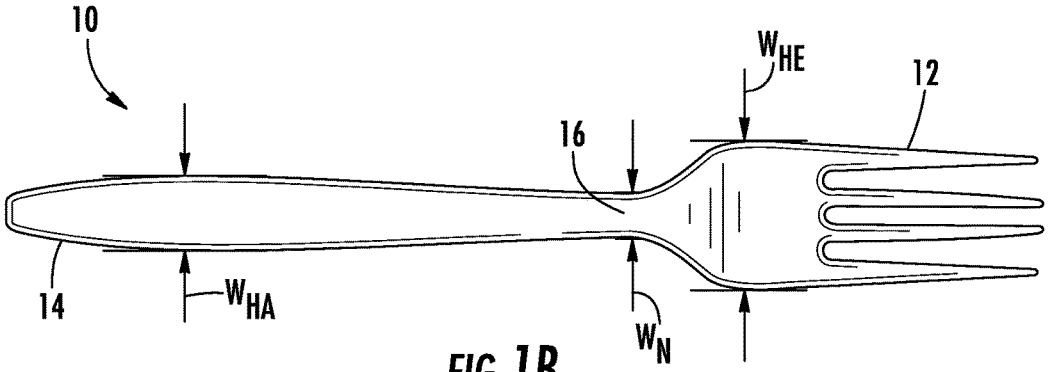
FIG. 1B is a top view of the example disposable cutlery utensil of FIG. 1A.

FIGS. 1A and 1B show a perspective view and a top view, respectively, of an example disposable cutlery utensil 10 according to one or more embodiments as may be described herein. Although the utensil 10 is shown as a fork in FIGS. 1A and 1B, the utensil 10 may be any type of cutlery utensil, including, for example, a fork, a spoon, a knife, or a spork. In some embodiments, the utensil 10 may be constructed of a moldable material. The moldable material may include a plastic, a combination of plastics, or a combination of plastics and other materials suitable for use in forming disposable cutlery. For example, the moldable material may include one or more of polystyrene, polyethylene, and polypropylene. In some embodiments, the utensil 10 may be constructed of a recyclable material.

As is shown, the utensil 10 may include a functional head 12, a handle 14, and a neck 16. The head 12 may be positioned at one end of the utensil 10 and may be configured to perform a function to assist a user in the consumption of food. For example, the head 12 may be configured for cutting, piercing, and/or scooping certain types of food for consumption. The handle 14 may be positioned at an opposite end of the utensil 10 and may be configured to be grasped by the user for holding and/or manipulating the utensil 10. FIG. 1B illustrates the relative widths of the head 12, the handle 14, and the neck 16 of the utensil 10 according to some embodiments. As is shown, a maximum width $W_{HE}$ of the head 12 may be greater than a maximum width $W_{HA}$ of the handle 14, and the maximum width $W_{HA}$ of the handle 14 may be greater than a maximum width $W_N$ of the neck 16. In this manner, the head 12 may be the widest portion of the utensil 10. According to other embodiments, the handle 14 or the neck 16 may be the widest portion of the utensil 10. For example, the handle 14 or the neck 16 may include a flange or shoulder feature having a maximum width that is greater than the maximum width $W_{HE}$ of the head 12. In some embodiments, the utensil 10 may include a flange or shoulder feature in addition to the head 12, the handle 14, and the neck 16, and the flange or shoulder feature may be the widest portion of the utensil 10. Such embodiments may be particularly useful when the utensil 10 is a knife, as the flange or shoulder feature may facilitate dispensing of the utensil 10 as desired via certain cutlery dispensers described herein below. In some embodiments, the utensil 10 may not include a neck 16. In such embodiments, the head 12 may extend directly from the handle 14.

Figure 2A:
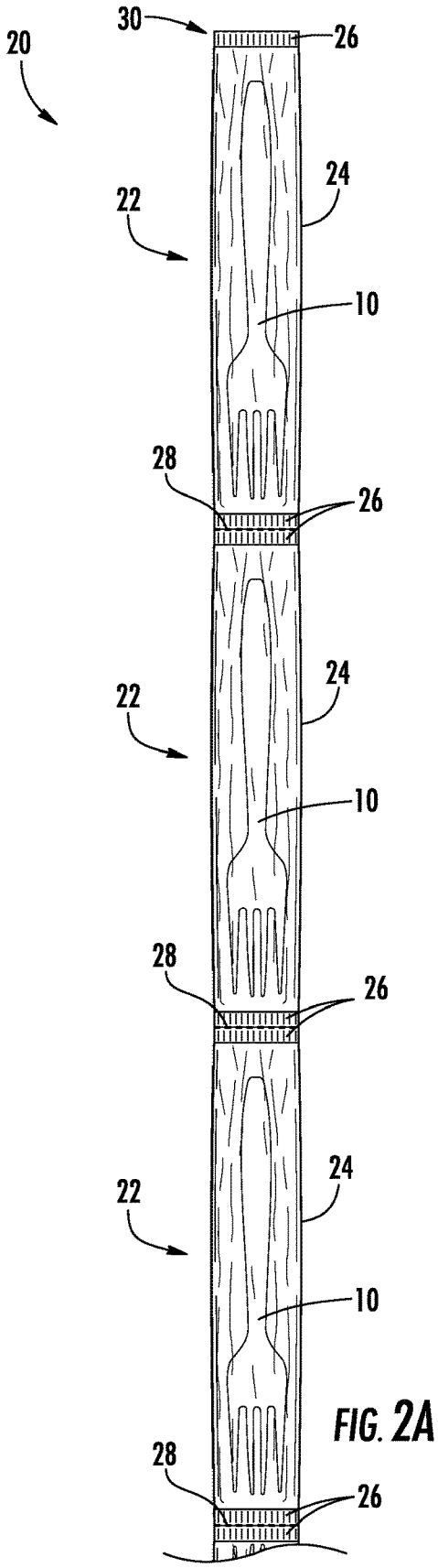
FIG. 2A is a top view of an example continuous band of wrapped disposable cutlery in accordance with one or more embodiments of the disclosure.

FIG. 2A shows an example continuous band of wrapped disposable cutlery 20 (which also may be referred to herein as a "wrapped cutlery band" or simply a "band") according to one or more embodiments as may be described herein. The band 20 may include a plurality of individually sealed cutlery packets 22 separably connected to one another in a serial manner. Each cutlery packet 22 may include an elongated pouch 24 and at least one disposable cutlery utensil 10 disposed within the pouch 24. In some embodiments, as is shown in FIG. 2A, each cutlery packet 22 may include a single utensil 10 disposed within the pouch 24. In other embodiments, more than one utensil 10 may be disposed within the pouch 24 of each cutlery packet 22. The cutlery packets 22 may have an elongated shape to accommodate the utensils 10 and may be connected end to end to form the wrapped cutlery band 20, as is shown.

The pouches 24 may be formed of a thin layer of disposable packaging material sealed in a manner to contain the utensils 10 therein. Specifically, each pouch 24 may include a seal 26 extending along both a leading end and a trailing end of the cutlery packet 22. In some embodiments, each pouch 24 may include the seal 26 extending along one or more sides of the cutlery packet 22. The pouches 24 may be constructed of a plastic, such as, for example, polyethylene, and the seals 26 may be formed by heat sealing the plastic along the ends and/or sides of the cutlery packets 22. Other suitable materials of construction may be used to form the pouches 24, and other suitable methods of forming the seals 26 may be used.

In some embodiments, the cutlery packets 22 may be separably connected to one another in a serial manner by zones of weakness 28 extending between the pouches 24 of adjacent cutlery packets 22. The zones of weakness 28 may be perforated zones, as is shown in FIG. 2A, including a plurality of perforations formed mechanically or otherwise, such as by a laser, according to various methods. Alternatively, the zones of weakness 28 may be scored zones including one or more score lines formed mechanically or otherwise, such as by a laser, according to various methods. Other suitable methods of forming the zones of weakness 28 may be used. As is shown in FIG. 2A, the zones of weakness 28 may be positioned between adjacent seals 26 of adjacent pouches 24 to facilitate separation of the cutlery packets 22 from one another via application of a tensile force. In this manner, upon separation of adjacent cutlery packets 22, the utensils 10 may remain sealed within their respective pouches 24. In other embodiments, the cutlery packets 22 may be separably connected to one another by a releasable adhesive applied to and joining the adjacent ends of adjacent pouches 24 to facilitate separation of the cutlery packets 22 in a similar manner via application of a tensile force. Still other suitable methods of separably connecting the cutlery packets 22 may be used.

In some embodiments, all of the utensils 10 of the wrapped cutlery band 20 may be oriented in a similar manner within their respective pouches 24. For example, the handles 14 of the utensils 10 may be oriented toward a leading end 30 of the band 20, as is shown in FIG. 2A. In this manner, the cutlery packet 22 at the leading end 30 easily may be grasped over the handle 14 of the utensil 10 contained therein and pulled to separate the cutlery packet 22 from the remainder of the band 20. Alternatively, the heads 12 of the utensils 10 may be oriented toward the leading end 30 of the band 20. In other embodiments, the utensils 10 of the band 20 may not be oriented in a similar manner within their respective pouches 24. For example, the handles 14 of the utensils 10 within some cutlery packets 22 may be oriented toward the leading end 30 of the band 20, while the heads 12 of the utensils 10 within other cutlery packets 22 may be oriented toward the leading end 30 of the band 20. As another example, each cutlery packet 22 may include one utensil 10 with the handle 14 oriented toward the leading end 30 of the band 20, and another utensil 10 with the head 12 oriented toward the leading end 30 of the band 20. In some embodiments, the wrapped cutlery band 20 may include a starter strip 32 positioned at the leading end 30 of the band 20 and configured to facilitate pulling the band 20 for loading a cutlery dispenser, as may be described in detail herein below.

Figure 2B:
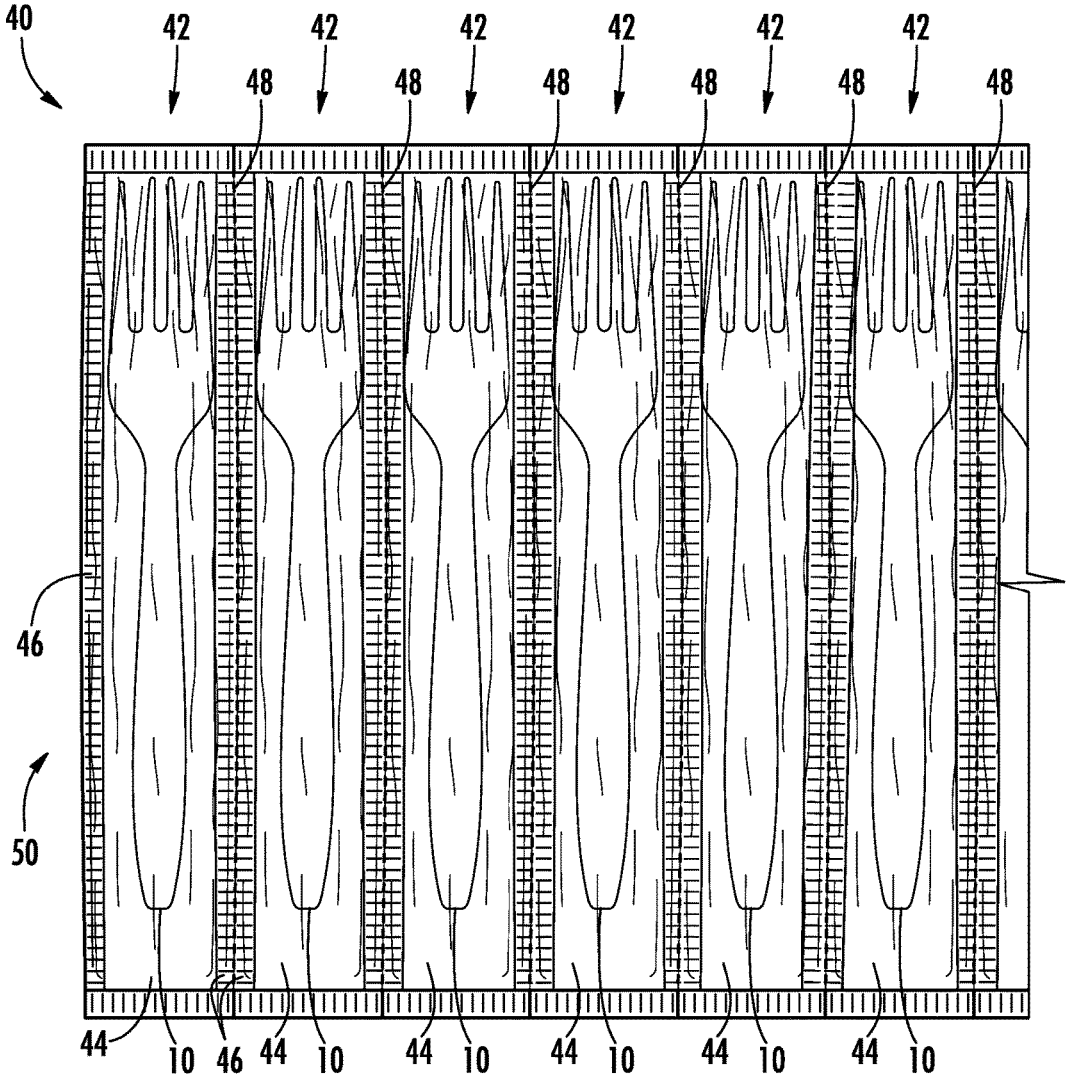
FIG. 2B is a top view of an example continuous band of wrapped disposable cutlery in accordance with one or more embodiments of the disclosure.

FIG. 2B shows an example continuous band of wrapped disposable cutlery 40 according to one or more embodiments as may be described herein. The band 40 may be generally similar to the band 20 described above with respect to FIG. 2A, although certain differences may be described herein below. The band 40 may include a plurality of individually sealed cutlery packets 42 separably connected to one another in a serial manner. Each cutlery packet 42 may include an elongated pouch 44 and at least one disposable cutlery utensil 10 disposed within the pouch 44. In some embodiments, as is shown in FIG. 2B, each cutlery packet 42 may include a single utensil 10 disposed within the pouch 44. In other embodiments, more than one utensil 10 may be disposed within the pouch 44 of each cutlery packet 42. The cutlery packets 42 may have an elongated shape to accommodate the utensils 10 and may be connected side to side to form the wrapped cutlery band 40, as is shown.

The pouches 44 may be formed of a thin layer of disposable packaging material sealed in a manner to contain the utensils 10 therein. Specifically, each pouch 44 may include a seal 46 extending along both a leading side and a trailing side of the cutlery packet 42. In some embodiments, each pouch 44 may include the seal 46 extending along the ends of the cutlery packet 42. The pouches 44 may be constructed of a plastic, such as, for example, polyethylene, and the seals 46 may be formed by heat sealing the plastic along the ends and/or sides of the cutlery packets 42. Other suitable materials of construction may be used to form the pouches 44, and other suitable methods of forming the seals 46 may be used.

In some embodiments, the cutlery packets 42 may be separably connected to one another in a serial manner by zones of weakness 48 extending between the pouches 44 of adjacent cutlery packets 42. The zones of weakness 48 may be perforated zones, as is shown in FIG. 2B, including a plurality of perforations formed mechanically or otherwise, such as by a laser, according to various methods. Alternatively, the zones of weakness 48 may be scored zones including one or more score lines formed mechanically or otherwise, such as by a laser, according to various methods. Other suitable methods of forming the zones of weakness 48 may be used. As is shown in FIG. 2B, the zones of weakness 48 may be positioned between adjacent seals 46 of adjacent pouches 44 to facilitate separation of the cutlery packets 42 from one another via application of a tensile force. In this manner, upon separation of adjacent cutlery packets 42, the utensils 10 may remain sealed within their respective pouches 44. In other embodiments, the cutlery packets 42 may be separably connected to one another by a releasable adhesive applied to and joining the adjacent ends of adjacent pouches 44 to facilitate separation of the cutlery packets 42 in a similar manner via application of a tensile force. Still other suitable methods of separably connecting the cutlery packets 42 may be used.

In some embodiments, all of the utensils 10 of the wrapped cutlery band 40 may be oriented in a similar manner within their respective pouches 44. For example, the handles 14 of the utensils 10 may be oriented toward one side of the band 40, as is shown in FIG. 2B. In other embodiments, the utensils 10 of the band 40 may not be oriented in a similar manner within their respective pouches 44. For example, the handles 14 of the utensils 10 within some cutlery packets 42 may be oriented toward one side of the band 40, while the heads 12 of the utensils 10 within other cutlery packets 42 may be oriented toward another side of the band 40. As another example, each cutlery packet 42 may include one utensil 10 with the handle 14 oriented toward one side of the band 40, and another utensil 10 with the head 12 oriented toward another side of the band 20. In some embodiments, the wrapped cutlery band 40 may include a starter strip 52 positioned at a leading end 50 of the band 40 and configured to facilitate pulling the band 24 for loading a cutlery dispenser, as may be described in detail herein below.

Figure 3A:
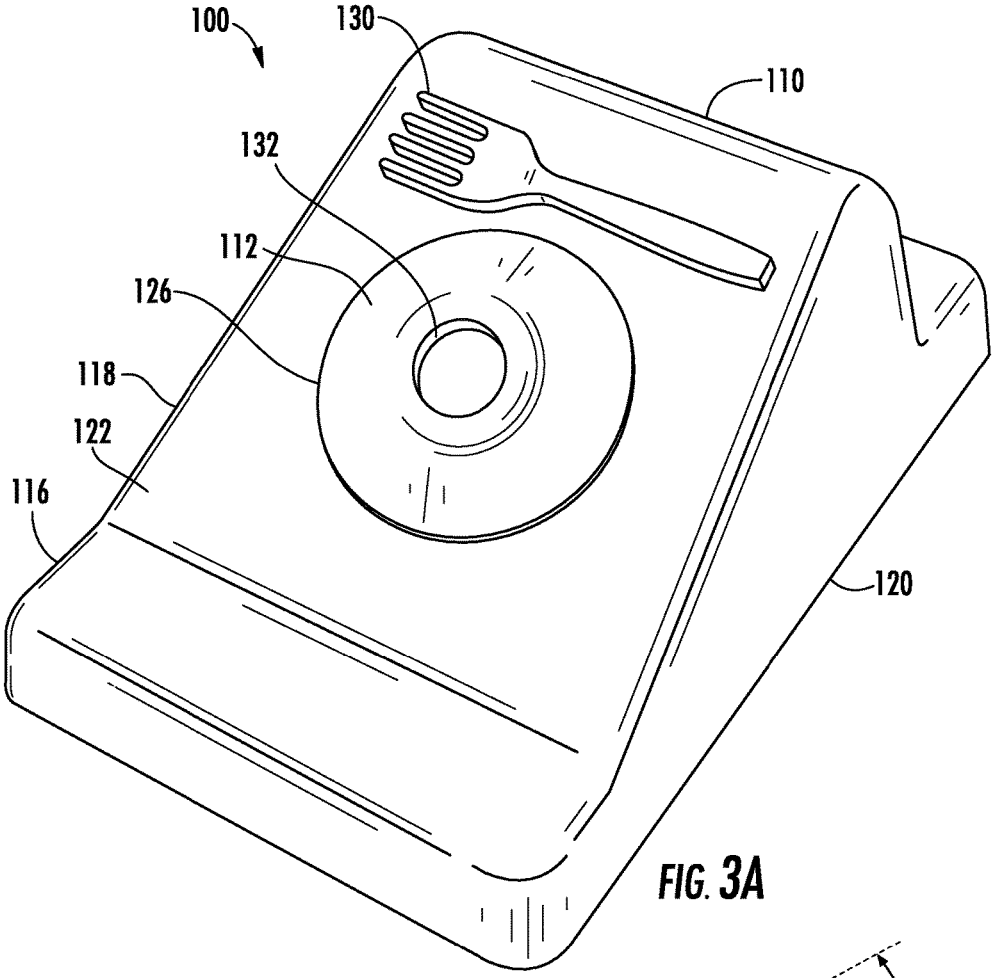
FIG. 3A is a perspective view of an example cutlery nozzle assembly for dispensing a continuous band of wrapped disposable cutlery in accordance with one or more embodiments of the disclosure.
Figure 3B:
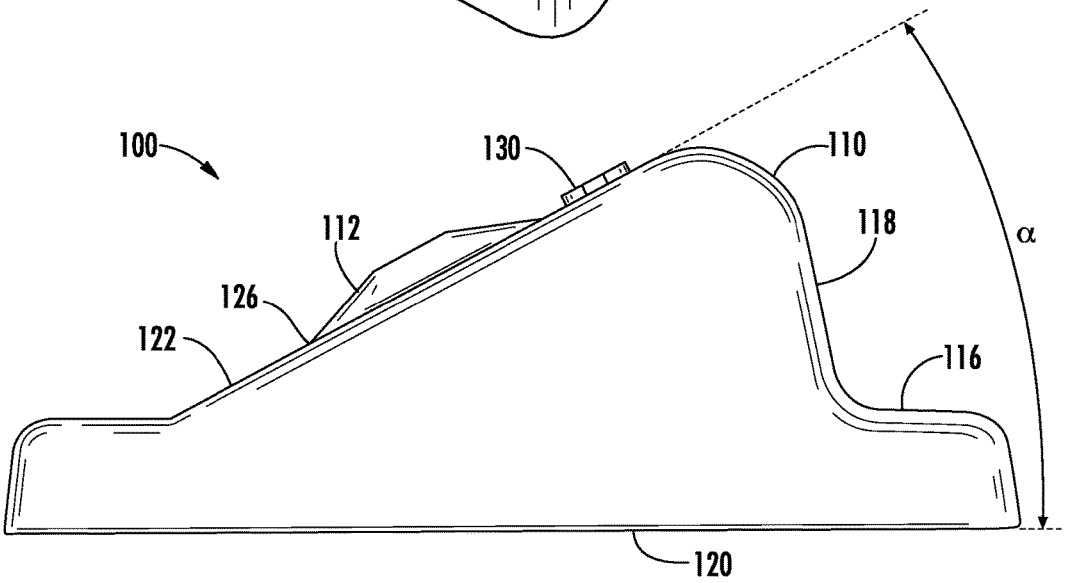
FIG. 3B is a side view of the example cutlery nozzle assembly of FIG. 3A.

FIGS. 3A and 3B show a perspective view and a side view, respectively, of an example cutlery nozzle assembly 100 for dispensing wrapped disposable cutlery according to one or more embodiments as may be described herein. The nozzle assembly 100 may be included in a cutlery dispenser for dispensing a continuous band of wrapped disposable cutlery, as may be described in detail herein below with respect to FIGS. 4A-4D. The nozzle assembly 100 may include a nozzle housing 110 and a nozzle 112 supported by the housing 110. Although the nozzle assembly 100 may be shown and described herein as being configured for dispensing the wrapped cutlery band 20 therefrom, the nozzle assembly 100 alternatively may be configured for dispensing the wrapped cutlery band 40 therefrom.

The nozzle housing 110 may include a mounting portion 116 and a support portion 118, as is shown. The nozzle housing 110 may be adapted to be mounted on a wall of a cutlery dispenser for use thereon. Specifically, the mounting portion 116 may be adapted to be mounted on the wall, and the mounting portion 116 may include a mounting surface 120 adapted to abut the wall. The mounting surface 120 may be substantially flat, as is shown, or contoured to accommodate the mating wall. The nozzle housing 110 may be adapted to be mounted on the wall by one or more mechanical fasteners, such as screws, bolts, pins, or hinges, or by one or more adhesives. As is shown, the support portion 118 may extend away from the mounting portion 116. In this manner, the support portion 118 may extend away from the wall on which the nozzle housing 110 may be mounted. The support portion 118 may include a support surface 122, and the nozzle 112 may be supported by the support surface 122. In some embodiments, the support surface 122 may extend at an angle $\alpha$ relative to the mounting surface 120. In this manner, the nozzle housing 110 may be configured to present the nozzle 112 at the angle $\alpha$ relative to the wall on which the nozzle assembly 100 is mounted for enhanced visibility and ease of use by a patron. The angle $\alpha$ may be within a suitable range to provide a suitable angle of approach for patrons using the nozzle assembly 100. In some embodiments, the angle $\alpha$ may be within a range of about 0° to about 90°, or about 15° to about 45°. In some embodiments, the angle $\alpha$ may be about 30°, as is shown. Other suitable angles of the support surface 122 may be used.

According to the embodiment of FIGS. 3A and 3B, the nozzle housing 110 may include an opening 126 defined therethrough. Specifically, the opening 126 may extend through the nozzle housing 110 from the support surface 122 to the mounting surface 120. The opening 126 may be configured to allow the wrapped cutlery band 20 to be dispensed therethrough. In some embodiments, the opening 126 may be configured to allow the cutlery packets 22 of the band 20 to be dispensed one at a time therethrough. As described above, the nozzle 112 may be supported by the support surface 122 of the housing 110. In some embodiments, the nozzle 112 may be positioned at least partially within the opening 126 and may extend at least partially over the support surface 122. In other embodiments, the nozzle 112 may be positioned about or around the opening 126 and may extend at least partially over the support surface 122. Similar to the opening 126, the nozzle 112 may be configured to allow the cutlery packets 22 of the band 20 to be dispensed one at a time therethrough, as may be described in detail herein below with respect to FIGS. 4A-4D.

The nozzle assembly 100 also may include a utensil indicator 130 configured to indicate the type of cutlery utensil 10 to be dispensed therefrom, such as a fork, a spoon, a knife, or a spork. In some embodiments, as is shown, the utensil indicator 130 may have the shape of the cutlery utensil 10 to be dispensed therefrom and may be a raised feature or a cutout feature of the nozzle housing 110. The utensil indicator 130 may be positioned on, or defined on or in, the mounting portion 116 or the support portion 118 of the housing 110. In other embodiments, the utensil indicator 130 may include letters spelling the name of the cutlery utensil 10 to be dispensed therefrom and similarly may be a raised feature or a cutout feature of the nozzle housing 110. In some embodiments, the nozzle housing 110 may be constructed of a substantially rigid material and thus may rigidly support the nozzle 112. For example, the nozzle housing 110 may be constructed of a plastic. Other suitable materials of construction may be used for the nozzle housing 110, which may be substantially rigid or substantially flexible.

According to some embodiments, as is shown in FIGS. 3A and 3B, the nozzle 112 may have a frustoconical shape and may define an orifice 132 extending therethrough. The nozzle 112 may be constructed of a material configured to flex or expand. In this manner, the orifice 132 may be configured to flex or expand to allow the cutlery packets 22 of the wrapped cutlery band 20 to be dispensed therethrough. In some embodiments, the nozzle 112 may be constructed of an elastomeric material having a suitable durometer. For example, the nozzle 112 may be constructed of a rubber material having a suitable durometer. Other suitable materials of construction having a suitable durometer may be used. In some embodiments, the orifice 132 may have a circular shape, as is shown. Other suitable shapes of the orifice 132 may be used, such as those described herein below with respect to FIGS. 8A-8E. In some embodiments, the orifice 132 may have a natural state diameter that is greater than the maximum width $W_N$ of the neck 16 of the cutlery utensil 10, less than the maximum width $W_{HA}$ of the handle 14, and less than the maximum width $W_{HE}$ of the head 12. In this manner, the orifice 132 may elastically expand or flex as the handle 14 of the cutlery utensil 10 is pulled therethrough. The orifice 132 then may contract to its natural state diameter about the neck 16 of the cutlery utensil 10. In a similar manner, the orifice 132 may elastically expand or flex as the head 12 of the cutlery utensil 10 is pulled therethrough, and then may contract to its natural state diameter again. In other embodiments, the orifice 132 may have a natural state diameter that is less than the maximum width $W_N$ of the neck 16 of the cutlery utensil 10, less than the maximum width $W_{HA}$ of the handle 14, and less than the maximum width $W_{HE}$ of the head 12. In this manner, the orifice 132 may flex or expand as the handle 14 of the cutlery utensil 10 is pulled therethrough. The orifice 132 then may contract toward, but not necessarily all the way to, its natural state diameter about the neck 16 of the cutlery utensil 10. In a similar manner, the orifice 132 may flex or expand as the head 12 of the cutlery utensil 10 is pulled therethrough, and then may contract toward or to its natural state diameter again. In some embodiments, the nozzle 112 may have a unitary or single-piece construction, as is shown in FIGS. 3A and 3B. In other embodiments, the nozzle 112 may have a "split" configuration including two or more separate portions, such as that described herein below with respect to FIGS. 7A-7E.

FIGS. 4A-4D show an example cutlery dispenser 200 and various steps of an example method for dispensing wrapped disposable cutlery from the cutlery dispenser 200 according to one or more embodiments of the disclosure, along with further details of the above-described nozzle assembly 100. As is shown, the cutlery dispenser 200 may include the nozzle assembly 100 and the wrapped cutlery band 20 configured to be dispensed therefrom. Although the cutlery dispenser 200 may be shown and described herein as including the wrapped cutlery band 20 for dispensing therefrom, the cutlery dispenser 200 alternatively may include the wrapped cutlery band 40 for dispensing therefrom.

Figure 4A:
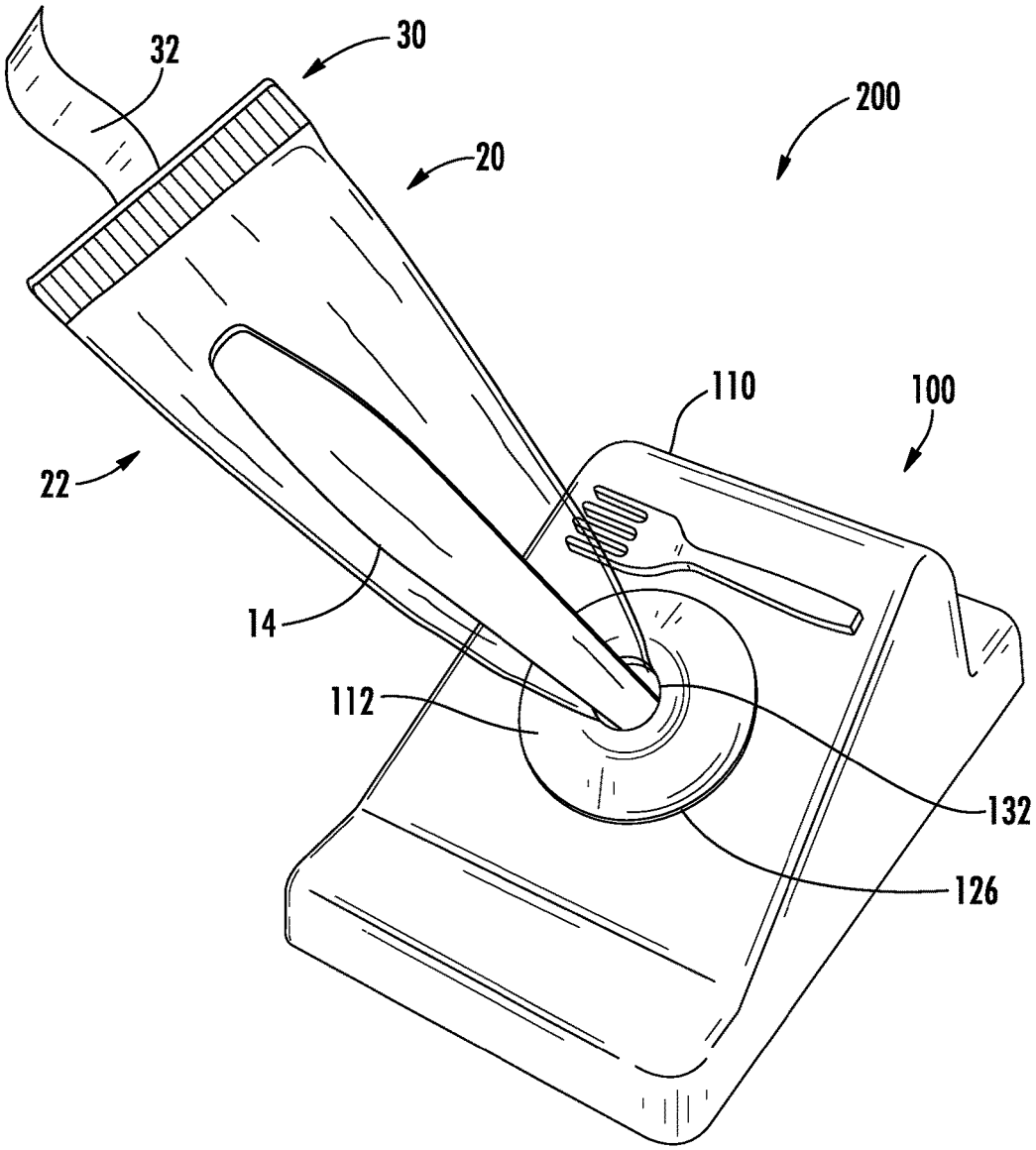
FIGS. 4A-4D are perspective views of an example cutlery dispenser and an example method of dispensing a continuous band of wrapped disposable cutlery from a cutlery dispenser in accordance with one or more embodiments of the disclosure.

According to embodiments in which the wrapped cutlery band 20 includes the starter strip 32 positioned at the leading end 30 thereof, the starter strip 32 may be pulled through the opening 126 and the nozzle 112 until the leading end of the first cutlery packet 22 extends through the nozzle 112. The starter strip 32 then may be removed from the leading end of the first cutlery packet 22, leaving the first cutlery packet 22 ready to be dispensed from the nozzle assembly 100. In some embodiments, as is shown in FIG. 4A, the first cutlery packet 22 may be oriented such that the handle 14 of the cutlery utensil 10 disposed therein extends through the nozzle 112, ready to be grasped by a patron, while the head 12 remains disposed within the cutlery dispenser 200.

As discussed above, the orifice 132 of the nozzle 112 may be configured to flex or expand to allow the cutlery packets 22 to be dispensed therethrough. In this manner, the orifice 132 may flex or expand as the handle 14 of the cutlery utensil 10 of the first cutlery packet 22 is pulled therethrough. The orifice 132 then may contract toward, or all the way to, its natural state diameter about the neck 16 of the cutlery utensil 10. Further, the nozzle 112 may be configured to prevent the first cutlery packet 22 from retracting into the cutlery dispenser 200 under gravitational forces acting on the cutlery packet 22 and the remainder of the wrapped cutlery band 20. In this manner, the nozzle 112 may be configured to retain the first cutlery packet 22 within the nozzle 112 and ready to be grasped by a patron, as is shown in FIG. 4A.

Figure 4B:
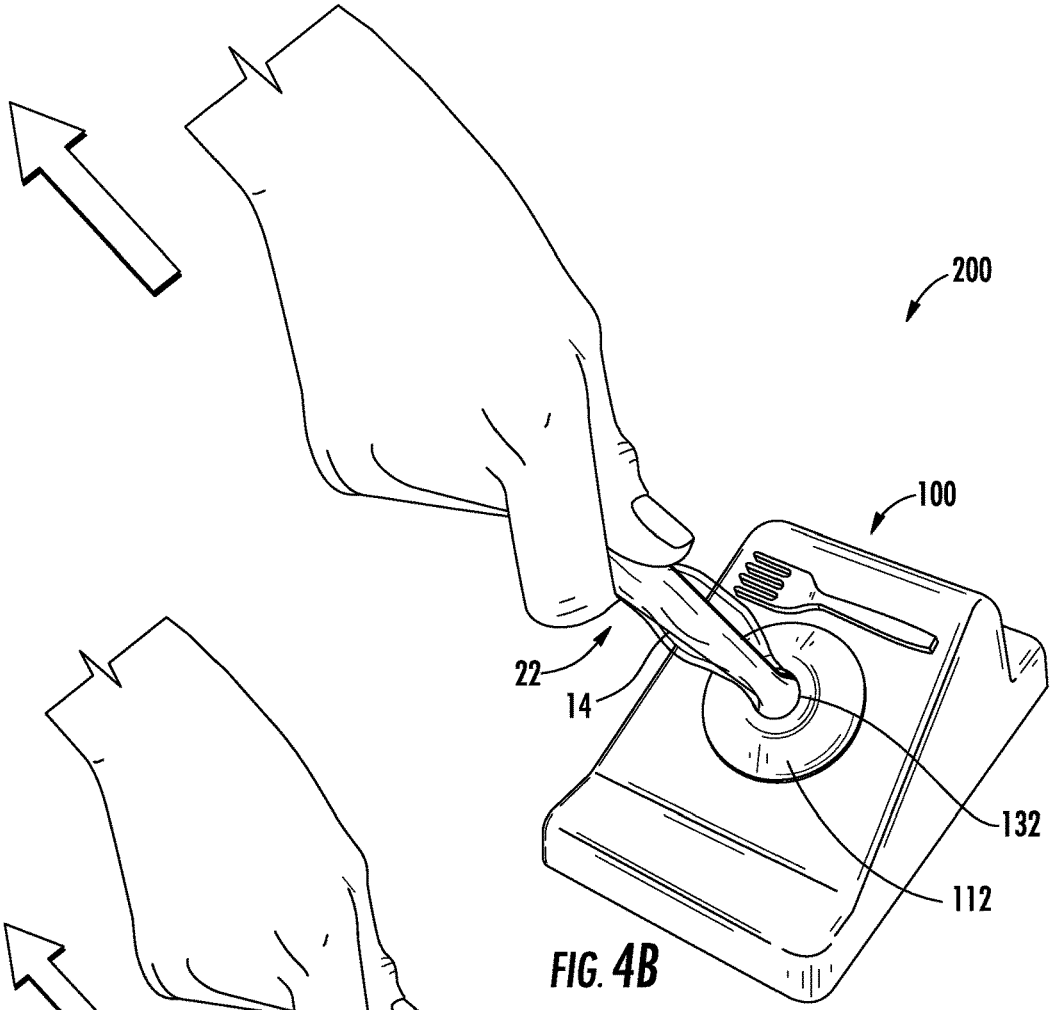

FIG. 4B shows a patron grasping the first cutlery packet 22 over the handle 14 of the cutlery utensil 10 and pulling the cutlery packet 22 away from the nozzle assembly 100. In doing so, the orifice 132 of the nozzle 112 may flex or expand as the head 12 of the cutlery utensil 10 is pulled therethrough. The orifice 132 then may contract toward, or all the way to, its natural state diameter about the trailing end of the first cutlery packet 22.

Figure 4C:
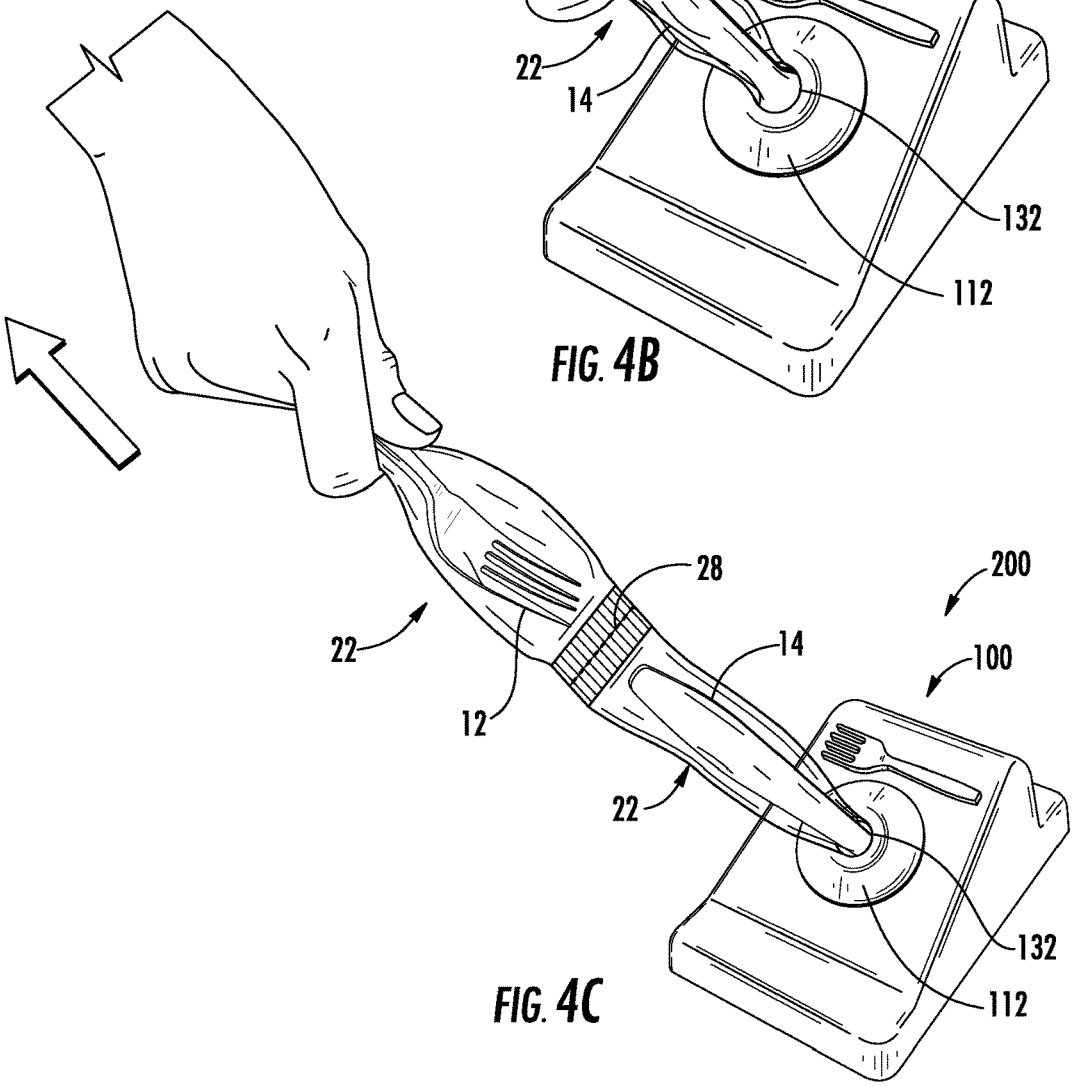

FIG. 4C shows the patron further pulling the first cutlery packet 22 away from the nozzle assembly 100, causing the leading end of the second cutlery packet 22 to be pulled through the nozzle 112. In doing so, the orifice 132 of the nozzle 112 may flex or expand as the handle 14 of the cutlery utensil 10 of the second cutlery packet 22 is pulled therethrough. The orifice 132 then may contract toward, or all the way to, its natural state diameter about the neck 16 of the cutlery utensil 10 of the second cutlery packet 22, while the head 12 remains disposed within the cutlery dispenser 200.

Figure 4D:
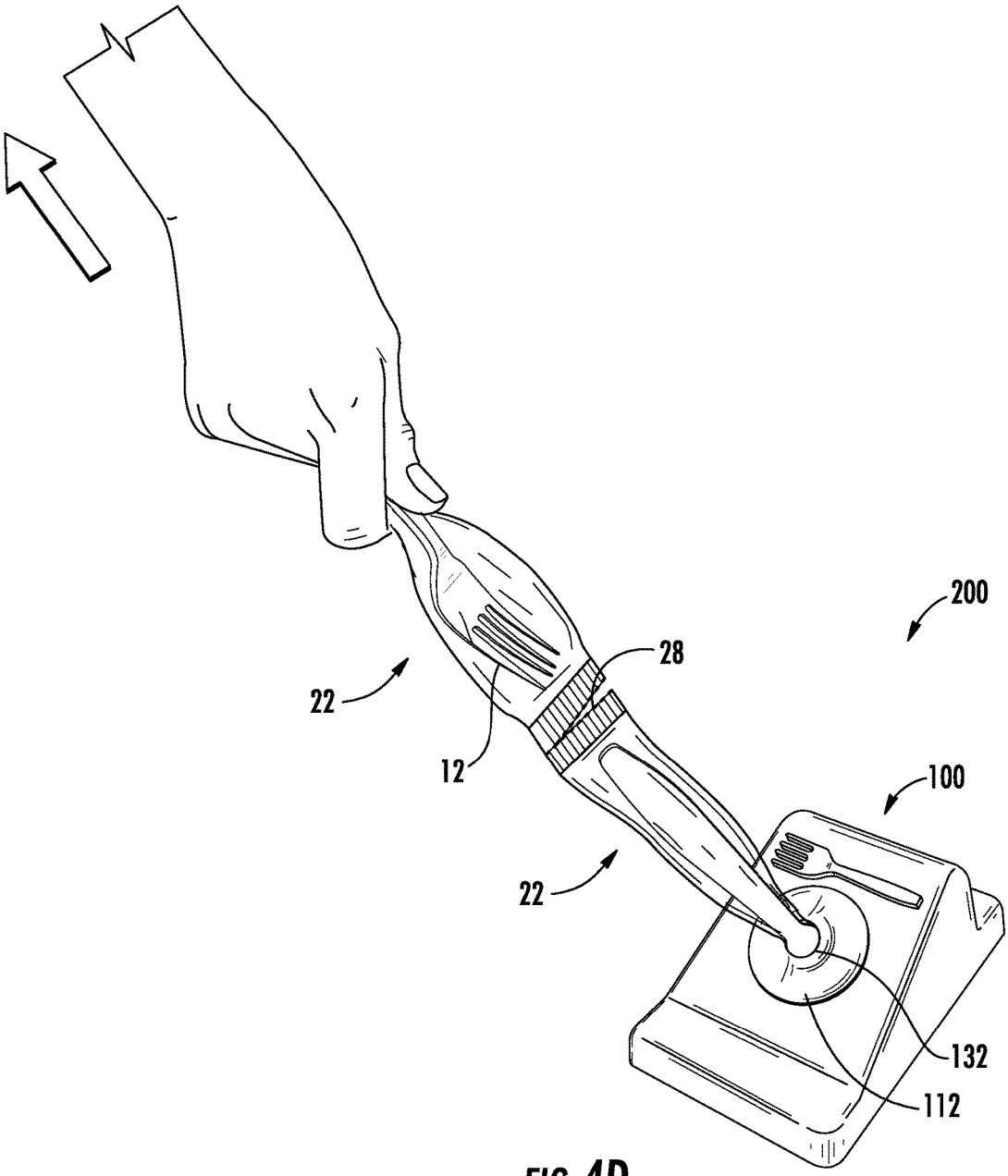

FIG. 4D shows the patron still further pulling the first cutlery packet 22 away from the nozzle assembly 100. In doing so, a tensile force is applied to the zone of weakness 28 extending between the first and second cutlery packets 22 as the nozzle 112 resists flexion or expansion about the head 12 of the cutlery utensil 10 of the second cutlery packet 22. The zone of weakness 28 may be configured such that the tensile force required to separate the first and second cutlery packets 22 is less than the pulling force required to pull the head 12 of the cutlery utensil 10 through the nozzle 112. In other words, the nozzle 112 may be configured such that the pulling force required to pull the head 12 of the cutlery utensil 10 therethrough is greater than the tensile force required to separate the first and second cutlery packets 22. In some embodiments, the nozzle 112 may be configured such that the pulling force required to pull the head 12 of the cutlery utensil 10 therethrough is at least double the tensile force required to separate the first and second cutlery packets 22. Other suitable relationships between the values of the pulling force and the tensile force may be used. Ultimately, when the pulling force applied by the patron exceeds the required tensile force, the zone of weakness 28 may break and thus the first cutlery packet 22 may be separated from the second cutlery packet 22 for use by the patron. Meanwhile, the nozzle 112 may retain the second cutlery packet 22 within the nozzle 112 and ready to be grasped by the next patron, as is shown in FIG. 4A. The steps of the example method described above and shown with respect to FIGS. 4A-4D may be repeated for dispensing each of the plurality of cutlery packets 22 of the wrapped cutlery band 20 from the dispenser 200.

Although the embodiments of the example method and the example cutlery dispenser 200 described above include the tensile force being applied to the zone of weakness 28 extending between the first and second cutlery packets 22 as a result of the nozzle 112 resisting flexion or expansion about the head 12 of the cutlery utensil 10 of the second cutlery packet 22, the tensile force may be generated in other ways according to other embodiments, depending on the configuration of the cutlery utensil 10. As described above, in some embodiments, the utensil 10 may include a flange or shoulder feature that is the widest portion of the utensil 10. According to such embodiments, the tensile force may be applied to the zone of weakness 28 extending between the first and second cutlery packets 22 as the nozzle 112 resists flexion or expansion about the flange or shoulder feature of the cutlery utensil 10 of the second cutlery packet 22. Such embodiments may be particularly useful when the utensil 10 is a knife.

Figure 5A:
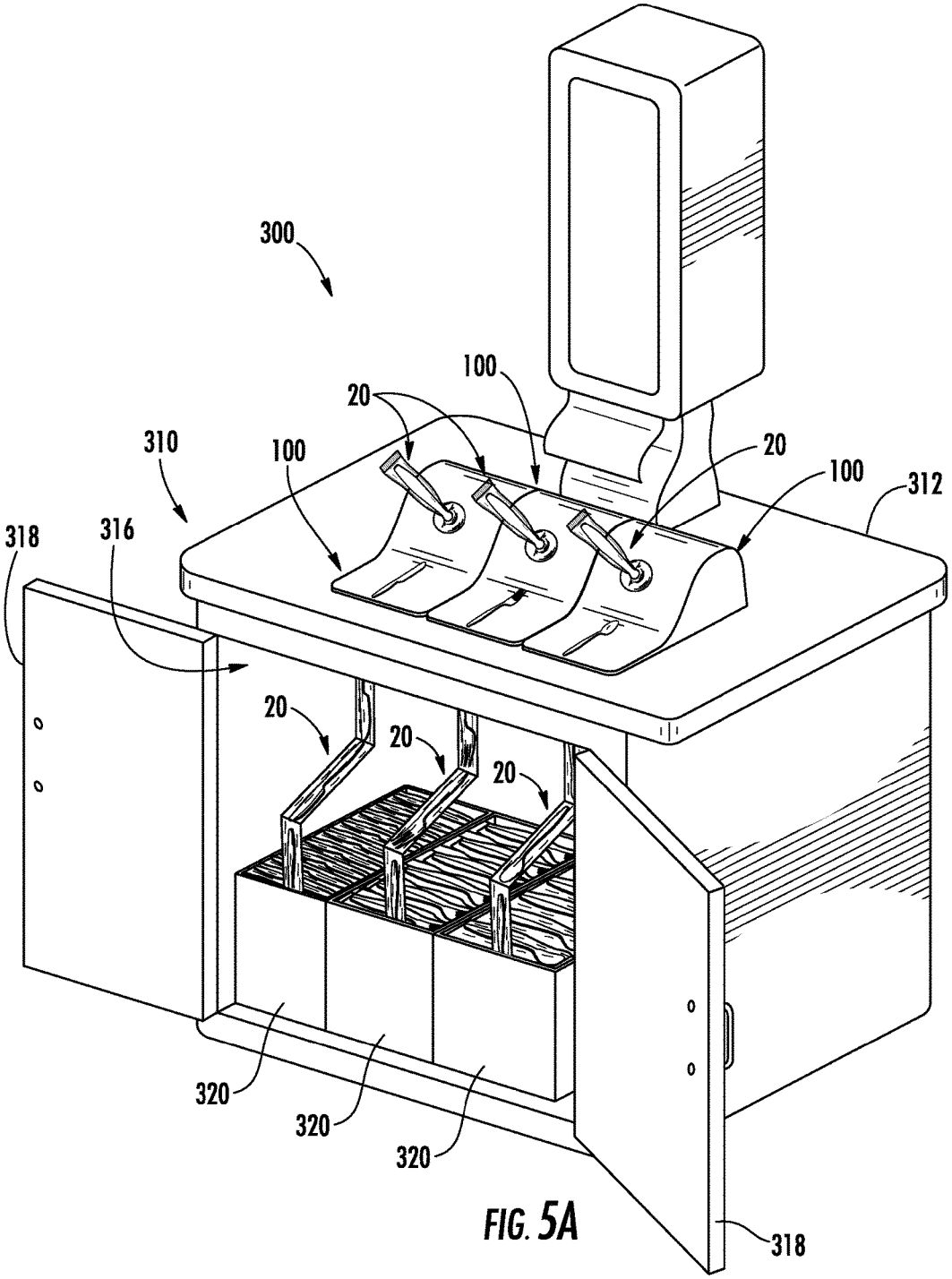
FIG. 5A is a perspective view of an example cutlery dispenser for dispensing a continuous band of wrapped disposable cutlery in accordance with one or more embodiments of the disclosure.
Figure 5B:
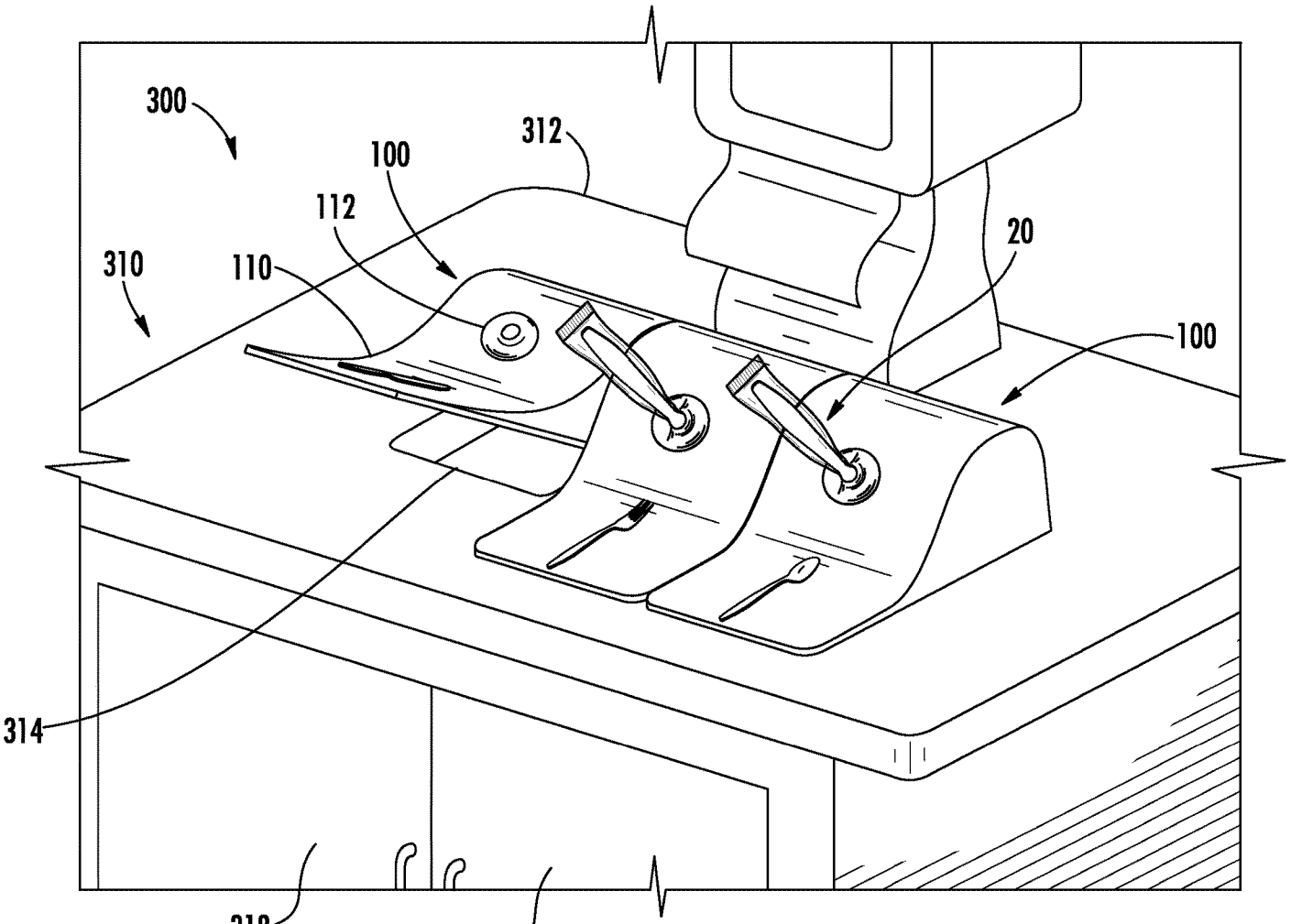
FIG. 5B is a detailed perspective view of a portion of the example cutlery dispenser of FIG. 5A.

FIGS. 5A and 5B show an example cutlery dispenser 300 for dispensing wrapped disposable cutlery according to one or more embodiments as may be described herein. The cutlery dispenser 300 may be generally similar to the dispenser 200 described above with respect to FIGS. 4A-4D, although certain differences may be described herein below. As is shown, the cutlery dispenser 300 may include one or more of the nozzle assemblies 100 and one or more of the wrapped cutlery bands 20 configured to be dispensed therefrom. Although the cutlery dispenser 300 may be shown and described herein as including the wrapped cutlery band 20 for dispensing therefrom, the cutlery dispenser 300 alternatively may include the wrapped cutlery band 40 for dispensing therefrom. The nozzle assembly 100 and the wrapped cutlery band 20 may be structurally and functionally configured in the manner described above with respect to FIGS. 3A and 3B and 4A-4D.

The cutlery dispenser 300 also may include a cabinet 310, and the nozzle assembly 100 may be mounted on the cabinet 310. Specifically, the nozzle assembly 100 may be mounted on a horizontal or vertical wall of the cabinet 310. In some embodiments, the cabinet 310 may include a countertop 312, and the nozzle assembly 100 may be mounted on the countertop 312, as is shown. The countertop 312 may include one or more apertures 314 extending therethrough, and the nozzle assembly 100 may be mounted over the aperture 314. In this manner, the wrapped cutlery band 20 may be passed through the aperture 314 of the countertop 312 for dispensing through the nozzle assembly 100. In some embodiments, the nozzle assembly 100 may be pivotally mounted to the countertop 312, as is shown in FIG. 5B, to facilitate loading of the leading end 30 of the wrapped cutlery band 20 into the nozzle assembly 100 for dispensing therefrom. Specifically, with the nozzle assembly 100 pivoted into the open configuration, as is shown, the first cutlery packet 22 of the band 20 easily may be brought through the aperture 314 and inserted into the nozzle 112 to be retained thereby for dispensing.

According to the embodiment of FIGS. 5A and 5B, the cabinet 310 may include a storage space 316 defined therein and positioned below the countertop 312. The cabinet 310 also may include one or more doors 318 at least partially defining the storage space 316 and configured to control access thereto. The wrapped cutlery band 20 may be disposed within the storage space 316, as is shown. In some embodiments, the cutlery dispenser 300 may include one or more cases 320 disposed within the storage space 316, and at least a portion of the wrapped cutlery band 20 may be disposed within the case 320. The portion of the wrapped cutlery band 20 may be disposed within the case 320 in a serpentine or zig-zag manner such that adjacent cutlery packets 22 are folded over one another and adjacent groups of cutlery packets 22 are stacked on top of or next to one another. Alternatively, the portion of the wrapped cutlery band 20 may be disposed within the case 320 in a rolled manner such that adjacent cutlery packets 22 are rolled over one another. Other suitable configurations of disposing the band 20 within the case 320 may be used. As is shown, the case 320 may define an internal volume within which a portion of the wrapped cutlery band 20 is disposed. In some embodiments, the wrapped cutlery band 20 may substantially fill the internal volume defined by the case 320 prior to dispensing of the band 20.

As is shown in FIG. 5A, the case 320 may include an open top configured to allow the wrapped cutlery band 20 to extend out of the case 320 and up to the nozzle assembly 100. Alternatively, the case 320 may include a substantially closed top having an opening defined therein and configured to allow the wrapped cutlery band 20 to extend out of the case 320 and up to the nozzle assembly 100. In some embodiments, the cutlery dispenser 300 may define a headspace within the storage space 316 and between the portion of the wrapped cutlery band 20 disposed within the case 320 and the countertop 312. In this manner, the headspace may be configured to allow the wrapped cutlery band 20, specifically the individual cutlery packets 22, to orient within the headspace to facilitate dispensing through the nozzle assembly 100, as is shown in FIG. 5A. In some embodiments, a height of the headspace may be greater than half of a length of the cutlery utensil 10. In some embodiments, the height of the headspace may be about the length of the cutlery utensil 10. Other suitable sizes for the height of the headspace may be used. According to other embodiments, the cutlery dispenser 300 may define the headspace within the case 320 and between the portion of the wrapped cutlery band 20 disposed within the case 320 and the top of the case 320. In still other embodiments, the cutlery dispenser 300 may define the headspace within the nozzle housing 110 and between the portion of the wrapped cutlery band 20 disposed within the case 320 and the inner surface of the nozzle housing 110 or the nozzle 112 itself.

In some embodiments, the case 320 may be constructed of cardboard and may be disposable. In this manner, the case 320 may be disposed of after the wrapped cutlery band 20 has been dispensed therefrom. In other embodiments, the case 320 may be constructed of a plastic and may be reusable. In this manner, after the wrapped cutlery band 20 has been dispensed from the case 320, another wrapped cutlery band 20 may be loaded into the case 320 for reuse. Other materials of construction may be used for the case 320, which may be either disposable or reusable.

Figure 6:
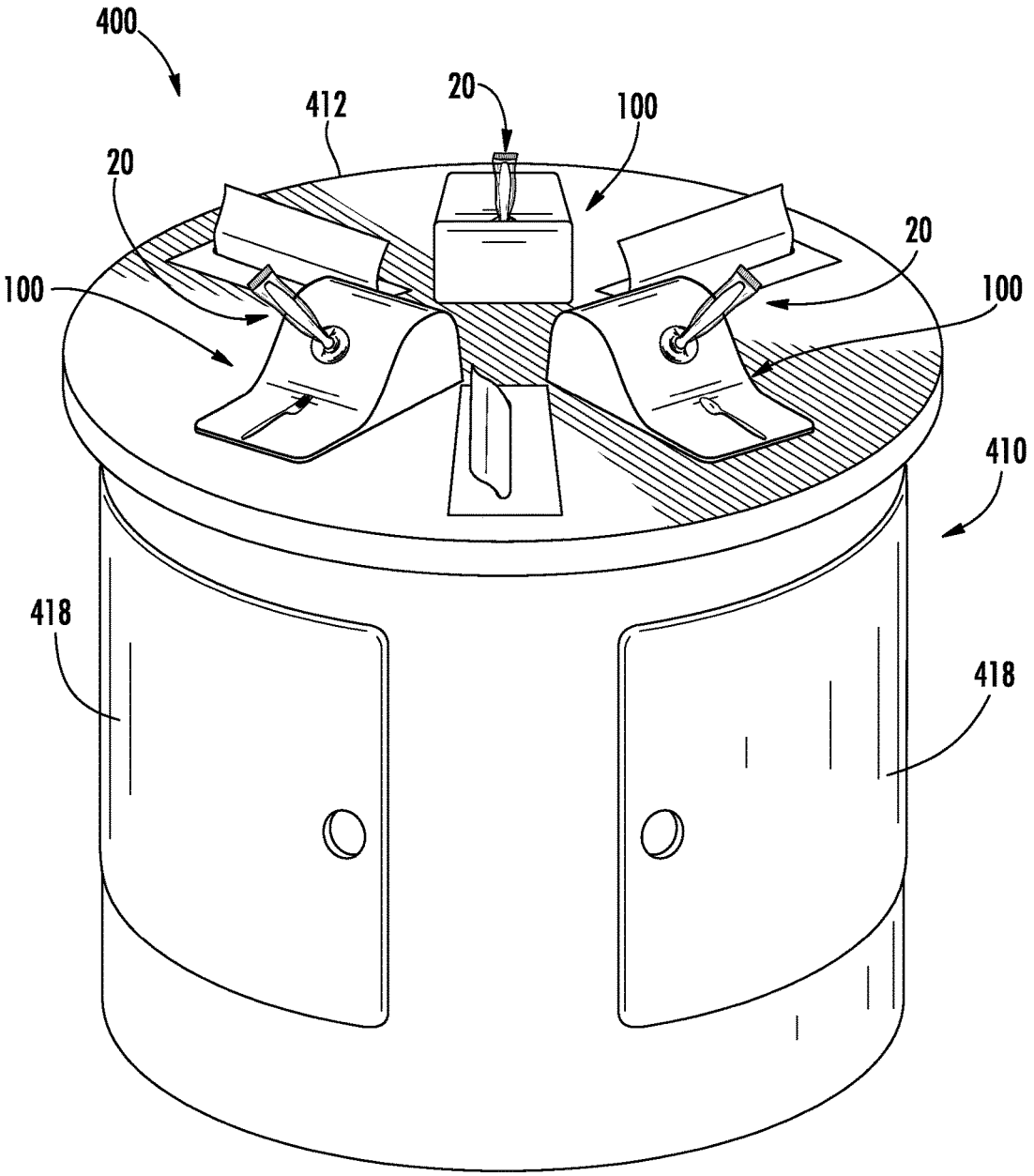
FIG. 6 is a perspective view of an example cutlery dispenser for dispensing a continuous band of wrapped disposable cutlery in accordance with one or more embodiments of the disclosure.

FIG. 6 shows an example cutlery dispenser 400 for dispensing wrapped disposable cutlery according to one or more embodiments as may be described herein. The cutlery dispenser 400 may be generally similar to the dispenser 300 described above with respect to FIGS. 5A and 5B, although certain differences may be described herein below. As is shown, the cutlery dispenser 400 may include one or more of the nozzle assemblies 100 and one or more of the wrapped cutlery bands 20 configured to be dispensed therefrom. Although the cutlery dispenser 400 may be shown and described herein as including the wrapped cutlery band 20 for dispensing therefrom, the cutlery dispenser 400 alternatively may include the wrapped cutlery band 40 for dispensing therefrom. The nozzle assembly 100 and the wrapped cutlery band 20 may be structurally and functionally configured in the manner described above with respect to FIGS. 3A and 3B and 4A-4D.

The cutlery dispenser 400 also may include a cabinet 410, and the nozzle assembly 100 may be mounted on the cabinet 410. The cabinet 410 may include a countertop 412, one or more apertures (not shown), a storage space (not shown), and one or more doors 418 configured in a manner similar to corresponding features of the cabinet 310 described herein above with respect to FIGS. 5A and 5B. As is shown, the cabinet 410 may have a circular shape, and the cutlery dispenser 400 may include a plurality of the nozzle assemblies 100 circumferentially spaced apart on the circular countertop 412. In this manner, the nozzle assemblies 100 may be accessed by patrons at different angles of approach toward the cutlery dispenser 400, which may be particularly advantageous for a high volume location.

The wrapped cutlery bands 20 may be disposed within the storage space of the cabinet 410. In some embodiments, the cutlery dispenser 400 may include one or more cases (not shown) disposed within the storage space and configured in a manner similar to the cases 320 of the cabinet 310 described herein above such that the wrapped cutlery bands 20 may be disposed therein.

Figure 7A:
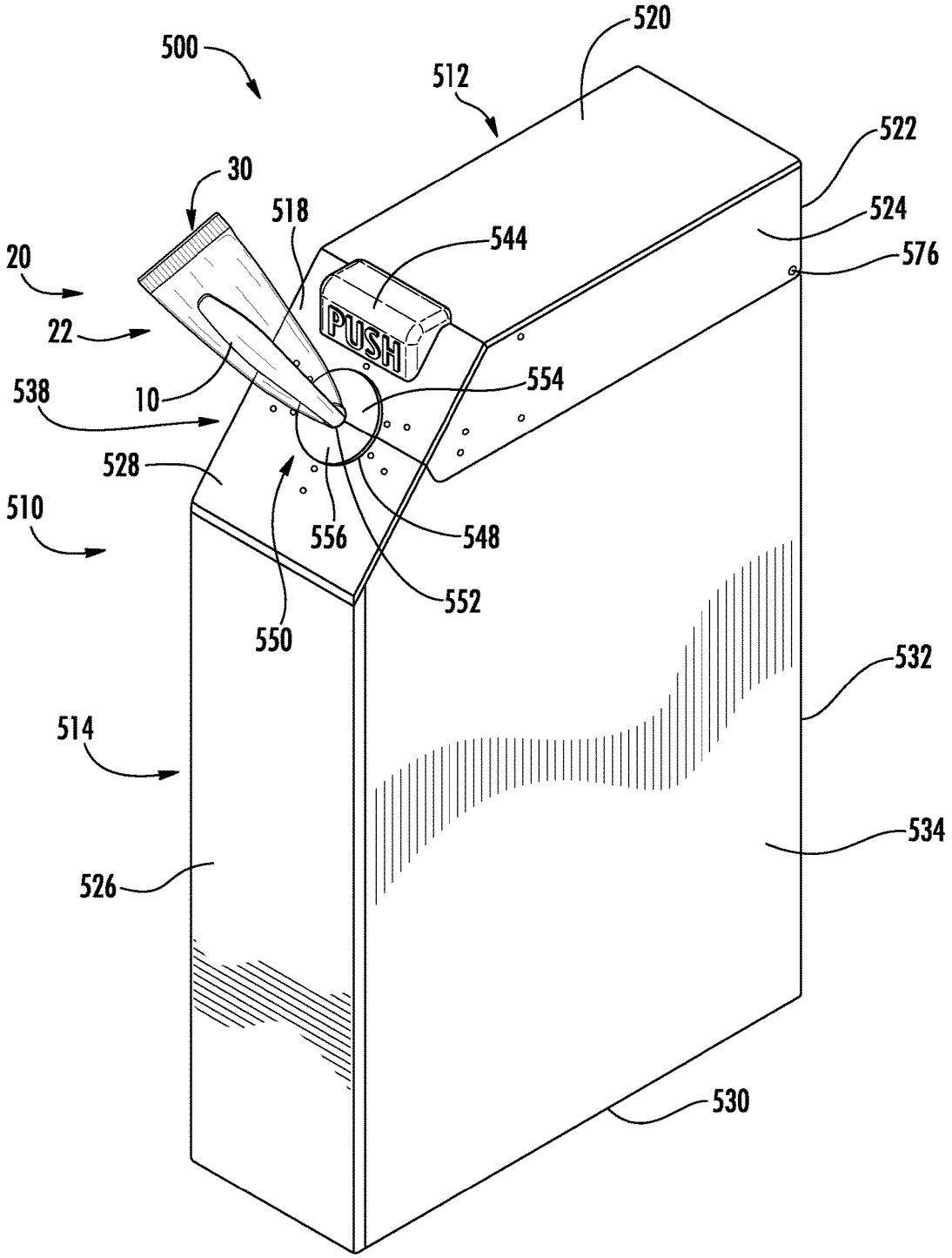
FIG. 7A is a perspective view of an example cutlery dispenser for dispensing a continuous band of wrapped disposable cutlery in accordance with one or more embodiments of the disclosure, showing a case of the dispenser in a closed configuration.
Figure 7B:
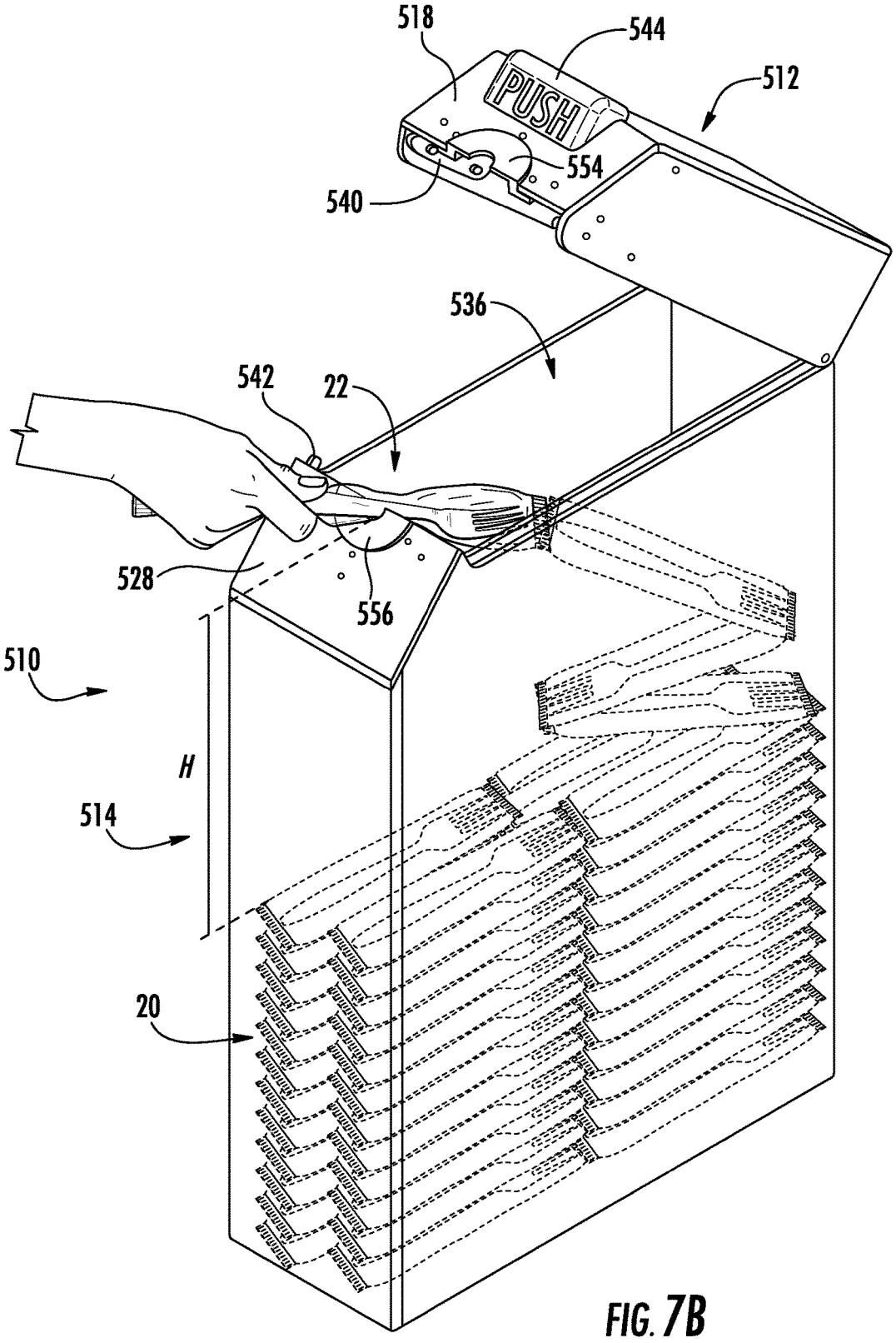
FIG. 7B is a perspective view of the example cutlery dispenser of FIG. 7A, showing the case in an open configuration.
Figure 7C:
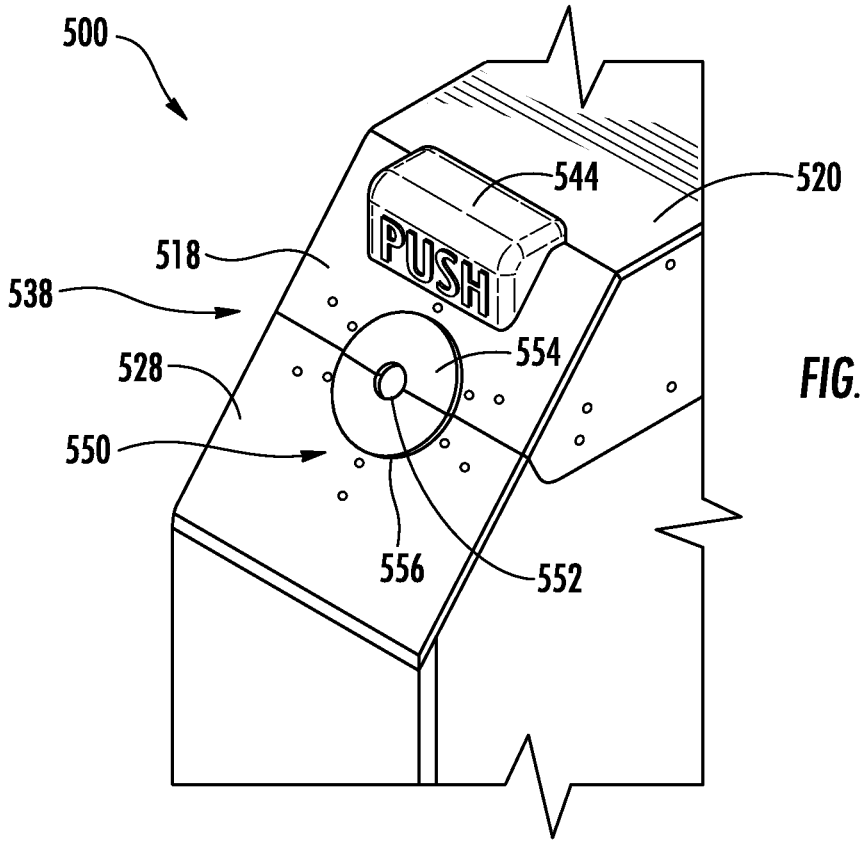
FIG. 7C is a detailed view of a portion of the example cutlery dispenser of FIG. 7A.

FIGS. 7A-7C show various views of an example cutlery dispenser 500 for dispensing wrapped disposable cutlery according to one or more embodiments as may be described herein. The cutlery dispenser 500 may be generally similar to the dispenser 300 described above with respect to FIGS. 5A and 5B, although certain differences may be described herein below. The cutlery dispenser 500 may include an openable case 510 and a wrapped cutlery band 20 disposed within the case 510 and configured to be dispensed therefrom. Although the cutlery dispenser 500 may be shown and described herein as including the wrapped cutlery band 20 for dispensing therefrom, the cutlery dispenser 500 alternatively may include the wrapped cutlery band 40 for dispensing therefrom.

The openable case 510 may be configured to move from a closed configuration, as is shown in FIGS. 7A and 7C, into an open configuration, as is shown in FIG. 7B. In this manner, the closed configuration of the case 510 may define an internal volume that is substantially closed from access thereto, and the open configuration of the case 510 may allow access to the internal volume. In some embodiments, the case 510 may include a lid 512 and a base 514, and the lid 512 may be movable relative to the base 514 to move the case 510 from the closed configuration into the open configuration. Specifically, as is shown, the lid 512 may be configured to pivot relative to the base 514 to move the case 510 from the closed configuration into the open configuration. In some embodiments, the lid 512 may extend along a top of the case 514 and may be configured to pivot upward relative to the base 514 about a hinge connection 516 between the lid 512 and the base 514. The hinge connection 516 may be positioned at a back of the case 510, as is shown.

According to the embodiment of FIGS. 7A-7C, the lid 512 may include a front wall 518, a top wall 520, a back wall 522, and two side walls 524. Further, the base 514 may include a front wall 526, a top wall 528, a bottom wall 530, a back wall 532, and two side walls 534. The bottom wall 530 of the base 514 may be substantially flat, such that the cutlery dispenser 500 may be placed on a countertop or other support surface for use thereon. The base 514 may define an opening 536 about a top of the base 514, which is covered by the lid 512 when the case 510 is in the closed configuration, and which is accessible when the case 510 is in the open configuration. As is shown, when the case 510 is in the closed configuration, the back wall 522 of the lid 512 may be generally coplanar with the back wall 532 of the base 514, the side walls 524 of the lid 512 may be generally coplanar with the respective side walls 534 of the base 514, and the front wall 518 of the lid 512 may be generally coplanar with the top wall 528 of the base 514. In this manner, when the case 510 is in the closed configuration, the front wall 518 of the lid 512 and the top wall 528 of the base 514 may collectively define a dispensing face 538 of the case 510. The dispensing face 538 may extend at an angle $\alpha$ relative to the bottom wall 530 of the base 514 and thus also relative to the countertop or other support surface on which the cutlery dispenser 500 is placed. The angle $\alpha$ may be within a suitable range to provide a suitable angle of approach for patrons using the cutlery dispenser 500. In some embodiments, the $\alpha$ may be within a range of about 15° to about 75°, or about 30° to about 60°. In some embodiments, the angle $\alpha$ may be about 45°, as is shown. Other suitable angles of the dispensing face 538 may be used.

In some embodiments, the cutlery dispenser 500 may include a locking mechanism configured to selectively lock the case 510 in the closed configuration. Specifically, as is shown, the locking mechanism may include one or more latches 540 slidably attached to the lid 512 and configured to releasably engage one or more protrusions 542 fixedly attached to the base 514. When the case 510 is in the closed configuration, the latches 540 may engage the protrusions 542 and thereby prevent the lid 512 from moving into the open configuration. In some embodiments, the latches 540 may be biased, such as by a spring or other biasing mechanism, into engagement with the protrusions 542. The locking mechanism also may include an actuator 544, such as a push button or other actuation mechanism, configured to disengage the latches 540 from the protrusions 542 upon actuation thereof. Specifically, the actuator 544 may be attached, either directly or indirectly, to the latches 540 and configured to overcome the biasing force of the spring in order to disengage the latches 540 from the protrusions 542 upon actuation thereof. In this manner, upon actuation of the actuator 544, the locking mechanism is unlocked and the lid 512 may be pivoted to move the case 510 from the closed configuration into the open configuration.

According to the embodiment of FIGS. 7A-7C, when the case 510 is in the closed configuration, the dispensing face 538 may define an opening 548 therein in communication with the internal volume of the case 510 and configured to allow the wrapped cutlery band 20 to be dispensed therethrough. As is shown, the opening 548 may be defined partially in the front wall 518 of the lid 512 and partially in the top wall 528 of the base 514. In some embodiments, the opening 548 may be configured to allow the cutlery packets 22 of the band 20 to be dispensed one at a time therethrough. The cutlery dispenser 500 also may include a nozzle 550 positioned about or within the opening 548 and configured to allow the wrapped cutlery band 20 to be dispensed therethrough. In this manner, the dispensing face 538 may be configured to present the nozzle 550 at the angle $\alpha$ relative to the countertop or other support surface on which the cutlery dispenser 500 is placed for enhanced visibility and ease of use by a patron in particular applications, depending on ergonomic need. Similar to the opening 548, the nozzle 550 may be configured to allow the cutlery packets 22 of the band 20 to be dispensed one at a time therethrough, in a manner similar to that of the nozzle 112 described herein above with respect to FIGS. 4A-4D.

In some embodiments, the nozzle 550 may have a frustoconical shape and may define an orifice 552 extending therethrough. The nozzle 550 may be constructed of a material configured to flex or expand. In this manner, the orifice 552 may be configured to flex or expand to allow the cutlery packets 22 of the wrapped cutlery band 20 to be dispensed therethrough. In some embodiments, the nozzle 550 may be constructed of an elastomeric material having a suitable durometer. For example, the nozzle 550 may be constructed of a rubber material having a suitable durometer. Other suitable materials of construction having a suitable durometer may be used. In some embodiments, the orifice 552 may have a circular shape, as is shown. Other suitable shapes of the orifice 552 may be used, such as those described herein below with respect to FIGS. 8A-8E. In some embodiments, the orifice 552 may have a natural state diameter that is greater than the maximum width $W_N$ of the neck 16 of the cutlery utensil 10, less than the maximum width $W_{HA}$ of the handle 14, and less than the maximum width $W_{HE}$ of the head 12. In this manner, the orifice 552 may flex or expand as the handle 14 of the cutlery utensil 10 is pulled therethrough. The orifice 552 then may contract to its natural state diameter about the neck 16 of the cutlery utensil 10. In a similar manner, the orifice 552 may flex or expand as the head 12 of the cutlery utensil 10 is pulled therethrough, and then may contract to its natural state diameter again. In other embodiments, the orifice 552 may have a natural state diameter that is less than the maximum width $W_N$ of the neck 16 of the cutlery utensil 10, less than the maximum width $W_{HA}$ of the handle 14, and less than the maximum width $W_{HE}$ of the head 12. In this manner, the orifice 552 may flex or expand as the handle 14 of the cutlery utensil 10 is pulled therethrough. The orifice 552 then may contract toward, but not necessarily all the way to, its natural state diameter about the neck 16 of the cutlery utensil 10. In a similar manner, the orifice 552 may flex or expand as the head 12 of the cutlery utensil 10 is pulled therethrough, and then may contract toward or to its natural state diameter again.

As is shown, the nozzle 550 may have a "split" configuration, whereby the nozzle 550 includes a first nozzle portion 554 and a second nozzle portion 556 that are separate from one another. In some embodiments, the nozzle 550 may be split along a centerline thereof, such that the first nozzle portion 554 and the second nozzle portion 556 each constitute a half of the nozzle 550 and are mirror images of one another. In other embodiments, the nozzle 550 may be split at a point offset from the centerline thereof, such that the first nozzle portion 554 constitutes a larger portion or a smaller portion of the nozzle 550 than the second nozzle portion 556. As is shown, the first nozzle portion 554 may be supported by the front wall 518 of the lid 512, and the second nozzle portion 556 may be supported by the top wall 528 of the base 514. In some embodiments, the first nozzle portion 554 may be positioned at least partially within the opening 548 and may extend at least partially over the front wall 518, and the second nozzle portion 556 may be positioned at least partially within the opening 548 and may extend at least partially over the top wall 528. In other embodiments, the first nozzle portion 554 may be positioned about or around the opening 548 and may extend at least partially over the front wall 518, and the second nozzle portion 556 may be positioned about or around the opening 548 and may extend at least partially over the top wall 528. Based on the split configuration of the nozzle 550, the first nozzle portion 554 and the second nozzle portion 556 may abut or otherwise be positioned adjacent one another when the case 510 is in the closed configuration, and may be separated from one another when the case 510 is in the open configuration. The split configuration of the nozzle 550 may facilitate loading of the wrapped cutlery band 20 within the nozzle 550 for dispensing therefrom. Specifically, as is shown in FIG. 7B, with the case 510 in the open configuration, the first cutlery packet 22 of the band 20 may be positioned about the second nozzle portion 556, and then the case 510 may be moved into the closed configuration such the first cutlery packet 22 is retained within the nozzle 550 for dispensing of the cutlery packets 22 therethrough. Specifically, the split configuration may provide a relief in the nozzle 550, such that the first nozzle portion 554 and the second nozzle portion 556 may flex or separate to allow the cutlery packets 22, in particular the widest portions of the cutlery utensils 10, to be dispensed therebetween.

In other embodiments, the nozzle 550 may have a unitary or single-piece construction, similar to that of the nozzle 112 described herein above with respect to FIGS. 3A and 3B, instead of the split configuration. In such embodiments, the nozzle 550 may be supported by the front wall 518 of the lid 512 and thus may move with the lid 512 when the case 510 is moved into the open configuration. Alternatively, the nozzle 550 may be supported by the top wall 528 of the base 514 and thus may remain stationary when the case 510 is moved into the open configuration. Either way, the open configuration of the case 510 may facilitate loading of the leading end 30 of the wrapped cutlery band 20 into the nozzle 550 for dispensing therefrom. Specifically, with the lid 512 pivoted into the open configuration, the first cutlery packet 22 of the band 20 easily may inserted into the nozzle 550 to be retained thereby for dispensing.

As is shown in FIG. 7B, the wrapped cutlery band 20 may be disposed within the case 510 and configured to be dispensed therefrom. The wrapped cutlery band 20 may be disposed within the case 510 in a serpentine or zig-zag manner such that adjacent cutlery packets 22 are folded over one another and adjacent groups of cutlery packets 22 are stacked on top of or next to one another. Alternatively, the wrapped cutlery band 20 may be disposed within the case 510 in a rolled manner such that adjacent cutlery packets 22 are rolled over one another. Other suitable configurations of disposing the band 20 within the case 510 may be used. In some embodiments, the wrapped cutlery band 20 may substantially fill the internal volume of the case 510 prior to dispensing of the band 20. As is shown, when the wrapped cutlery band 20 is initially loaded in the cutlery dispenser 500, a majority of the cutlery packets 22 is disposed in a compact manner, such as a stack or a roll, within a lower portion of the case 510, while a few of the cutlery packets 22, such as three or four cutlery packets, extend upward away from the stack or roll and toward the dispensing face 538. The cutlery dispenser 500 may define a headspace within the case 510 and between the top of the stack or the roll of the cutlery packets 22 and the nozzle 550. In this manner, the headspace may be configured to allow the wrapped cutlery band 20, specifically the individual cutlery packets 22, to orient within the headspace to facilitate dispensing through the nozzle 550, as is shown. In some embodiments, a height H of the headspace may be greater than half of a length of the cutlery utensil 10. In some embodiments, the height H of the headspace may be about the length of the cutlery utensil 10. Other suitable sizes for the height H of the headspace may be used.

In some embodiments, the case 510 may be reusable. In this manner, after the wrapped cutlery band 20 has been dispensed from the case 510, another wrapped cutlery band may be loaded into the case 510 for reuse. In other embodiments, the case 510 may be disposable. In this manner, the case 510 may be disposed of after the wrapped cutlery band 20 has been dispensed therefrom. Various suitable materials of construction may be used for the case 510, which may be either reusable or disposable.

Figure 7D:
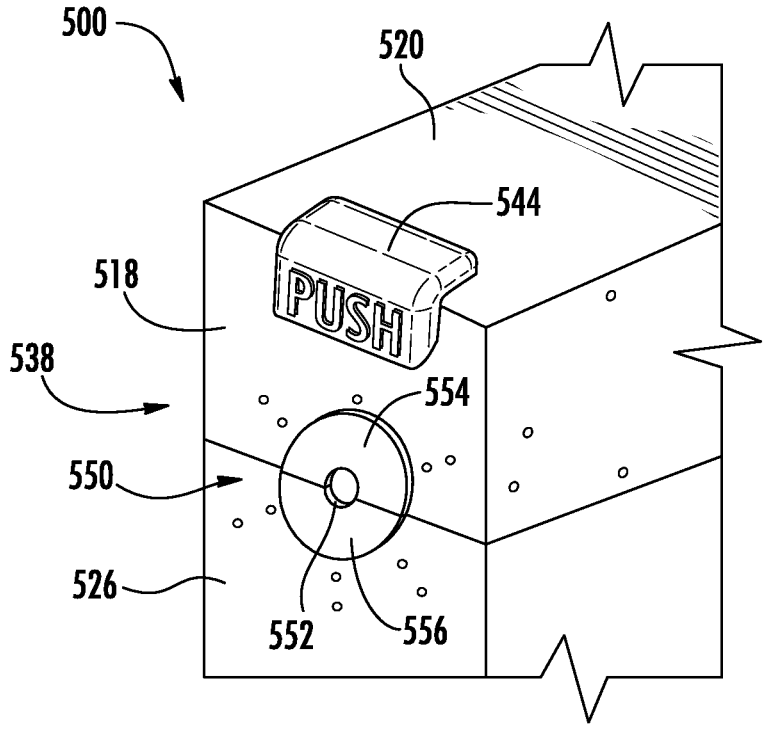
FIG. 7D is a detailed view of a portion of an example cutlery dispenser for dispensing a continuous band of wrapped disposable cutlery in accordance with one or more embodiments of the disclosure, showing a case of the dispenser in a closed configuration.

FIG. 7D shows a detailed view of an alternative embodiment of the cutlery dispenser 500. As is shown, when the case 510 is in the closed configuration, the front wall 518 of the lid 512 may be generally coplanar with the front wall 526 of the base 514, and the front wall 518 of the lid 512 and the front wall 526 of the base 514 may collectively define the dispensing face 538 of the case 510. In this manner, the dispensing face 538 may extend perpendicular to the bottom wall 530 of the base 514 and thus also perpendicular to the countertop or other support surface on which the cutlery dispenser 500 is placed. Accordingly, the dispensing face 538 may be configured to present the nozzle 550 in a head-on manner for enhanced visibility and ease of use by a patron in particular applications, depending on ergonomic need.

Figure 7E:
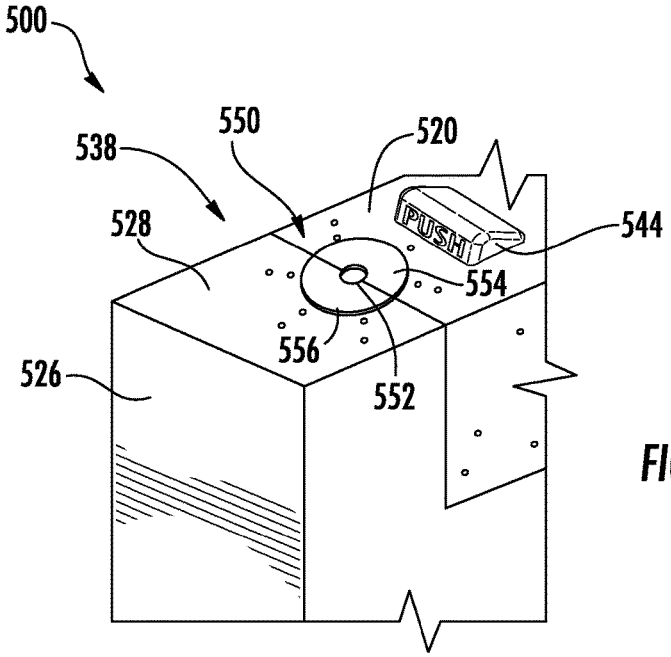
FIG. 7E is a detailed view of a portion of an example cutlery dispenser for dispensing a continuous band of wrapped disposable cutlery in accordance with one or more embodiments of the disclosure, showing a case of the dispenser in a closed configuration.

FIG. 7E shows a detailed view of another alternative embodiment of the cutlery dispenser 500. As is shown, when the case 510 is in the closed configuration, the top wall 520 of the lid 512 may be generally coplanar with the top wall 528 of the base 514, and the top wall 520 of the lid 512 and the top wall 528 of the base 514 may collectively define the dispensing face 538 of the case 510. In this manner, the dispensing face 538 may extend parallel to the bottom wall 530 of the base 514 and thus also parallel to the countertop or other support surface on which the cutlery dispenser 500 is placed. Accordingly, the dispensing face 538 may be configured to present the nozzle 550 in an upward-facing manner for enhanced visibility and ease of use by a patron in particular applications, depending on ergonomic need.

As discussed above, during use of the cutlery dispenser 500, the orifice 552 of the nozzle 550 may be configured to flex or expand to allow the cutlery packets 22 to be dispensed therethrough. Based on the split configuration of the nozzle 550, the first nozzle portion 554 and the second nozzle portion 556 may be configured to flex or separate to allow the cutlery packets 22 to be dispensed therebetween. In this manner, according to embodiments in which the nozzle 550 has the split configuration, the orifice 552 may flex or expand and/or the first nozzle portion 554 and the second nozzle portion 556 may flex or separate as the handle 14 of the cutlery utensil 10 of the first cutlery packet 22 is pulled through the nozzle 550. The orifice 552 then may contract toward, or all the way to, its natural state diameter and/or the first nozzle portion 554 and the second nozzle portion 556 may return toward, or all the way to, their natural state position about the neck 16 of the cutlery utensil 10. The nozzle 550 may be configured to prevent the first cutlery packet 22 from retracting into the cutlery dispenser 500 under gravitational forces acting on the cutlery packet 22 and the remainder of the wrapped cutlery band 20. In this manner, the nozzle 550 may be configured to retain the first cutlery packet 22 within the nozzle 550 and ready to be grasped by a patron.

As the first cutlery packet 22 is pulled away from the cutlery dispenser 500 by the patron, the orifice 552 may flex or expand and/or the first nozzle portion 554 and the second nozzle portion 556 may flex or separate as the head 12 of the cutlery utensil 10 of the first cutlery packet 22 is pulled through the nozzle 550. The orifice 552 then may contract toward, or all the way to, its natural state diameter and/or the first nozzle portion 554 and the second nozzle portion 556 may return toward, or all the way to, their natural state position about the trailing end of the first cutlery packet 22.

As the first cutlery packet 22 is further pulled away from the cutlery dispenser 500 by the patron, the leading end of the second cutlery packet 22 may be pulled through the nozzle 112. In doing so, the orifice 552 may flex or expand and/or the first nozzle portion 554 and the second nozzle portion 556 may flex or separate as the handle 14 of the cutlery utensil 10 of the second cutlery packet 22 is pulled through the nozzle 550. The orifice 552 then may contract toward, or all the way to, its natural state diameter and/or the first nozzle portion 554 and the second nozzle portion 556 may return toward, or all the way to, their natural state position about the neck 16 of the cutlery utensil 10, while the head 12 remains disposed within the case 510.

As the first cutlery packet 22 is still further pulled away from the cutlery dispenser 500 by the patron, a tensile force is applied to the zone of weakness 28 extending between the first and second cutlery packets 22 as the nozzle 550 resists expansion and/or separation about the head 12 of the cutlery utensil 10 of the second cutlery packet 22. The zone of weakness 28 may be configured such that the tensile force required to separate the first and second cutlery packets 22 is less than the pulling force required to pull the head 12 of the cutlery utensil 10 through the nozzle 550. In other words, the nozzle 550 may be configured such that the pulling force required to pull the head 12 of the cutlery utensil 10 therethrough is greater than the tensile force required to separate the first and second cutlery packets 22. In some embodiments, the nozzle 550 may be configured such that the pulling force required to pull the head 12 of the cutlery utensil 10 therethrough is at least double the tensile force required to separate the first and second cutlery packets 22. Other suitable relationships between the values of the pulling force and the tensile force may be used. Ultimately, when the pulling force applied by the patron exceeds the required tensile force, the zone of weakness 28 may break and thus the first cutlery packet 22 may be separated from the second cutlery packet 22 for use by the patron. Meanwhile, the nozzle 550 may retain the second cutlery packet 22 within the nozzle 550 and ready to be grasped by the next patron. These steps may be repeated for dispensing each of the plurality of cutlery packets 22 of the wrapped cutlery band 20 from the dispenser 500.

Although the embodiments of the example method and the example cutlery dispenser 500 described above include the tensile force being applied to the zone of weakness 28 extending between the first and second cutlery packets 22 as a result of the nozzle 550 resisting expansion and/or separation about the head 12 of the cutlery utensil 10 of the second cutlery packet 22, the tensile force may be generated in other ways according to other embodiments, depending on the configuration of the cutlery utensil 10. As described above, in some embodiments, the utensil 10 may include a flange or shoulder feature that is the widest portion of the utensil 10. According to such embodiments, the tensile force may be applied to the zone of weakness 28 extending between the first and second cutlery packets 22 as the nozzle 550 resists expansion and/or separation about the flange or shoulder feature of the cutlery utensil 10 of the second cutlery packet 22. Such embodiments may be particularly useful when the utensil 10 is a knife.

FIGS. 8A-8E show front views of an example nozzle 600 according to various embodiments as may be described herein. The nozzle 600 may be used in the nozzle assembly 100 described herein above instead of the nozzle 112, and thus may be used in the cutlery dispenser 200, the cutlery dispenser 300, or the cutlery dispenser 400. The nozzle 600 also may be used in the cutlery dispenser 400 described herein above instead of the nozzle 550. In some embodiments, the nozzle 600 may have a unitary or single-piece construction, similar to that of the nozzle 112. In other embodiments, the nozzle 600 may have a split configuration including two or more separate portions, similar to that of the nozzle 550. The nozzle 600 may be configured to allow the cutlery packets 22 of the band 20 to be dispensed one at a time therethrough, in a manner similar to that of the nozzle 112 and the nozzle 550 described herein above.

Figure 8A:
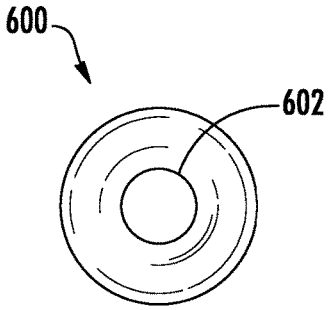
FIG. 8A is a front view of an example nozzle in accordance with one or more embodiments of the disclosure.

The nozzle 600 may have a frustoconical shape and may define an orifice 602 extending therethrough. In some embodiments, the orifice 602 may have a circular shape, as is shown in FIG. 8A. A natural state diameter of the orifice 602 may be substantially smaller than an outer diameter of the nozzle 600, as is shown. During use, the orifice 602 may flex or expand and/or the nozzle portions may flex or separate as the widest portion, such as the head 12, of the cutlery utensil 10 is pulled through the nozzle 600.

Figure 8B:
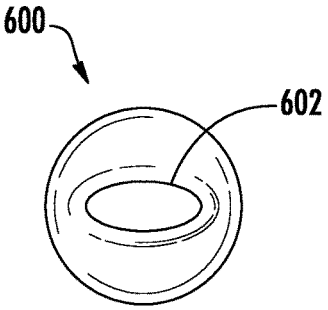
FIG. 8B is a front view of an example nozzle in accordance with one or more embodiments of the disclosure.

In some embodiments, the orifice 602 may have an oval shape, as is shown in FIG. 8B. A natural state length of the orifice 602, corresponding to a major axis thereof, and a natural state width of the orifice 602, corresponding to a minor axis thereof, may be substantially smaller than an outer diameter of the nozzle 600, as is shown. During use, the orifice 602 may flex or expand and/or the nozzle portions may flex or separate as the widest portion, such as the head 12, of the cutlery utensil 10 is pulled through the nozzle 600.

Figure 8C:
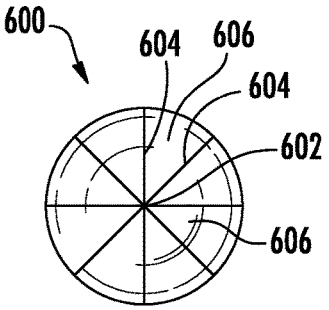
FIG. 8C is a front view of an example nozzle in accordance with one or more embodiments of the disclosure.

In some embodiments, the orifice 602 may include a plurality of slits 604 that intersect one another at or near a center of the nozzle 600, as is shown in FIG. 8C. The slits 604 may have a generally linear shape, as is shown, or may have a generally curved shape. The slits 604 may extend completely across an outer diameter of the nozzle 600, as is shown, or may extend across only a portion of the outer diameter of the nozzle 600. The nozzle 600 may include a plurality of flaps 606 defined by the slits 604, whereby each flap 600 is defined between two adjacent slits 604, as is shown. The slits 604 may provide reliefs in the nozzle 600, such that the flaps 606 may flex or separate to allow the cutlery packets 22 to be dispensed therebetween. During use, the orifice 602 may flex or expand and/or the flaps 606 may flex or separate as the widest portion, such as the head 12, of the cutlery utensil 10 is pulled through the nozzle 600.

Figure 8D:
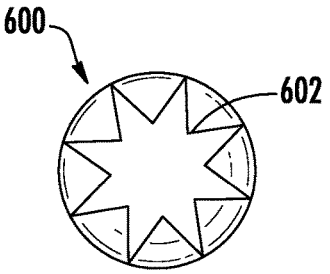
FIG. 8D is a front view of an example nozzle in accordance with one or more embodiments of the disclosure.
Figure 8E:
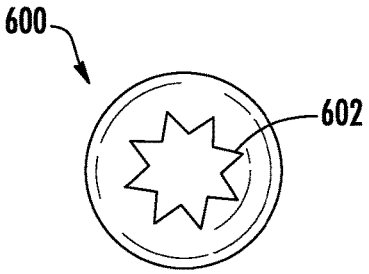
FIG. 8E is a front view of an example nozzle in accordance with one or more embodiments of the disclosure.

In some embodiments, the orifice 602 may have a star shape, as is shown in FIGS. 8D and 8E. The nozzle 600 may include a plurality of flaps 606 defined by the star-shaped orifice 602, as is shown. A natural state outer diameter of the orifice 602 (as defined by outer points of the star shape) may be substantially equal to an outer diameter of the nozzle 600, as is shown in FIG. 8D. Alternatively, a natural state outer diameter of the orifice 602 may be substantially smaller than an outer diameter of the nozzle 600, as is shown in FIG. 8E. During use, the orifice 602 may flex or expand and/or the flaps 606 may flex or separate as the widest portion, such as the head 12, of the cutlery utensil 10 is pulled through the nozzle 600. Still other suitable shapes of the orifice 602 may be used according to other embodiments of the nozzle 600.

The present disclosure thus provides improved cutlery dispensers and related methods for dispensing wrapped disposable cutlery to address one or more of the potential drawbacks of known dispensers and methods described above. For example, the cutlery dispensers may include a wrapped cutlery band including cutlery packets having cutlery utensils individually sealed within separate pouches to address hygiene concerns. Moreover, the dispensers may be configured to dispense the cutlery packets one at a time in a manner such that a patron contacts only the cutlery packet dispensed for his or her use, which further facilitates hygienic dispensing. Such dispensing of the cutlery packets one at a time also may prevent patrons from unintentionally taking more than one cutlery packet.

The cutlery dispensers provided herein also may significantly reduce the time required to setup or load the dispensers for use. In some embodiments, the dispenser may include a case that may be used for both shipping and dispensing the wrapped cutlery band. The case may be disposed within a cabinet, and the leading end of the wrapped cutlery band may be extended from the case to a nozzle assembly for dispensing. In this manner, the dispenser may be loaded merely by placing the case within the cabinet and extending the leading end of the band to the nozzle assembly. Due to their straightforward structural configuration, the dispensers easily may be sized for different applications appropriate for low-volume locations or high-volume locations. Further, due to the straightforward nozzle assembly used, the cutlery dispensers may have a very low incidence of malfunction during dispensing of the cutlery packets. Finally, the cutlery dispensers may occupy a limited amount of space in an eating facility, as the wrapped cutlery band and the nozzle assembly may allow for a straightforward and compact configuration, which may occupy a very limited amount of counterspace. Additional improvements of the cutlery dispensers and methods provided herein will be appreciated by those of ordinary skill in the art.

Although certain embodiments of the disclosure are described herein and shown in the accompanying drawings, one of ordinary skill in the art will recognize that numerous modifications and alternative embodiments are within the scope of the disclosure. Moreover, although certain embodiments of the disclosure are described herein with respect to specific exemplary cutlery dispenser configurations, it will be appreciated that numerous other cutlery dispenser configurations are within the scope of the disclosure. Conditional language used herein, such as "can," "could," "might," or "may," unless specifically stated otherwise, or otherwise understood within the context as used, generally is intended to convey that certain embodiments could include, while other embodiments do not include, certain features, elements, or functional capabilities. Thus, such conditional language generally is not intended to imply that certain features, elements, or functional capabilities are in any way required for one or more embodiments.

We claim:

1. A cutlery dispenser for dispensing wrapped cutlery, the dispenser comprising:

a wrapped cutlery band comprising a plurality of cutlery packets separably connected to one another in a serial manner, wherein each cutlery packet comprises a pouch and a cutlery utensil disposed within the pouch, wherein the cutlery utensil comprises a head and a handle, and wherein a maximum width of the head is greater than a maximum width of the handle; and a nozzle assembly configured to allow the cutlery packets to be dispensed therethrough, wherein the nozzle assembly comprises a flexible or expandable nozzle defining an orifice extending therethrough, wherein the nozzle is configured such that a pulling force required to pull the head through the orifice is greater than a tensile force required to separate adjacent cutlery packets and such that a pulling force required to pull the handle through the orifice is less than the tensile force required to separate adjacent cutlery packets, wherein the orifice has a natural state dimension extending across the orifice and between opposing sides of the orifice when the nozzle is in a natural state, and wherein the natural state dimension of the orifice is less than the maximum width of the head.

2. The cutlery dispenser of claim 1, wherein the maximum width of the head is located along an intermediate portion of the head spaced apart from opposite ends of the head, and wherein the maximum width of the handle is located along an intermediate portion of the handle spaced apart from opposite ends of the handle.

3. The cutlery dispenser of claim 1, wherein each cutlery packet is individually sealed by one or more seals extending along the pouch.

4. The cutlery dispenser of claim 1, wherein the cutlery packets are separably connected to one another by zones of weakness extending between adjacent cutlery packets.

5. The cutlery dispenser of claim 1, wherein the cutlery packets have an elongated shape and are connected end to end.

6. The cutlery dispenser of claim 1, wherein the nozzle is configured to allow the cutlery packets to be dispensed one at a time through the orifice.

7. The cutlery dispenser of claim 1, wherein the nozzle is formed of an elastomeric material configured to expand to allow the cutlery packets to be pulled through the orifice.

8. The cutlery dispenser of claim 1, wherein the orifice has a circular shape such that the natural state dimension of the orifice is a natural state diameter of the orifice.

9. The cutlery dispenser of claim 1, wherein the natural state dimension of the orifice is less than the maximum width of the handle.

10. The cutlery dispenser of claim 9, wherein the cutlery utensil further comprises a neck positioned between the head and the handle, and wherein the natural state dimension of the orifice is greater than a maximum width of the neck.

11. The cutlery dispenser of claim 9, wherein the cutlery utensil further comprises a neck positioned between the head and the handle, and wherein the natural state dimension of the orifice is less than a maximum width of the neck.

12. The cutlery dispenser of claim 1, wherein the cutlery packets are separably connected to one another by zones of weakness extending between adjacent cutlery packets, and wherein each zone of weakness is configured such that a tensile force required to break the zone of weakness is less than the pulling force required to pull the head through the orifice.

13. The cutlery dispenser of claim 12, wherein each zone of weakness comprises a plurality of perforations.

14. The cutlery dispenser of claim 1, wherein the nozzle assembly further comprises a nozzle housing, and wherein the nozzle is supported by the nozzle housing.

15. The cutlery dispenser of claim 14, wherein the nozzle housing comprises a mounting portion and a support portion, wherein the mounting portion is adapted to be mounted on a wall, and wherein the support portion supports the nozzle.

16. The cutlery dispenser of claim 14, wherein the nozzle housing comprises an opening defined therethrough, and wherein the nozzle is disposed at least partially within the opening.

17. The cutlery dispenser of claim 14, wherein the nozzle housing comprises a utensil indicator configured to indicate a type of cutlery utensil to be dispensed from the nozzle assembly.

18. The cutlery dispenser of claim 1, further comprising a cabinet, wherein the nozzle assembly is mounted on the cabinet.

19. The cutlery dispenser of claim 18, further comprising a case, wherein the case is disposed within a storage space of the cabinet, and wherein a portion of the wrapped cutlery band is disposed within the case.

20. A method for dispensing wrapped cutlery from the cutlery dispenser of claim 1, the method comprising:

providing the cutlery dispenser; and dispensing a portion of the wrapped cutlery band through the nozzle assembly.

21. The method of claim 20, wherein the nozzle is configured such that a pulling force required to pull the handle through the orifice is less than the tensile force required to separate adjacent cutlery packets.

22. The method of claim 20, wherein dispensing a portion of the wrapped cutlery band through the nozzle assembly comprises dispensing two of the cutlery packets one at a time through the orifice.

23. The method of claim 20, wherein dispensing a portion of the wrapped cutlery band through the nozzle assembly comprises pulling a first cutlery packet through the orifice.

24. The method of claim 20, wherein dispensing a portion of the wrapped cutlery band through the nozzle assembly comprises expanding the orifice.

25. The method of claim 20, wherein the orifice has a circular shape such that the natural state dimension of the orifice is a natural state diameter of the orifice.

26. The method of claim 20, wherein the cutlery utensil further comprises a neck positioned between the head and the handle, and wherein the natural state dimension of the orifice is greater than a maximum width of the neck.

27. The method of claim 20, wherein the natural state dimension of the orifice is less than the maximum width of the handle.

28. The method of claim 20, wherein dispensing a portion of the wrapped cutlery band through the nozzle assembly comprises pulling a first cutlery packet through the orifice and pulling a second cutlery packet partially through the orifice.

29. The method of claim 28, wherein pulling the second cutlery packet partially through the orifice comprises pulling the second cutlery packet by pulling the first cutlery packet.

30. The method of claim 28, wherein pulling the second cutlery packet partially through the orifice separates the first cutlery packet from the second cutlery packet.

31. The method of claim 28, wherein the first cutlery packet and the second cutlery packet are separably connected to one another by a zone of weakness.

32. The method of claim 31, wherein the zone of weakness comprises a plurality of perforations.

33. A cutlery dispenser for dispensing wrapped cutlery, the dispenser comprising:

a case configured to move from a closed configuration into an open configuration, wherein the case comprises a base, a lid configured to move with respect to the base to move the case from the closed configuration into the open configuration, and an opening defined in a dispensing face of the case;

a flexible or expandable nozzle attached to the case and disposed about or within the opening, wherein the nozzle defines an orifice extending through the nozzle, and wherein the orifice is smaller than the opening; and a wrapped cutlery band disposed within the case and configured to be dispensed therefrom through the opening and the orifice when the case is in the closed configuration, wherein the wrapped cutlery band comprises a plurality of cutlery packets separably connected to one another in a serial manner, wherein each cutlery packet comprises a pouch and a cutlery utensil disposed within the pouch, wherein the cutlery utensil comprises a head and a handle, wherein a maximum width of the head is greater than a maximum width of the handle, wherein the orifice has a natural state dimension extending across the orifice and between opposing sides of the orifice when the nozzle is in a natural state, and wherein the natural state dimension of the orifice is less than the maximum width of the head and less than the maximum width of the handle.

34. The cutlery dispenser of claim 33, wherein the cutlery utensil further comprises a neck positioned between the head and the handle, and wherein the natural state dimension of the orifice is greater than a maximum width of the neck.

35. The cutlery dispenser of claim 33, wherein the nozzle is formed of an elastomeric material configured to expand to allow the cutlery packets to be pulled through the orifice.

36. The cutlery dispenser of claim 33, wherein each cutlery packet comprises a pouch and a cutlery utensil disposed within the pouch.

37. The cutlery dispenser of claim 33, wherein the nozzle is configured to allow the cutlery packets to be dispensed one at a time through the orifice.

38. The cutlery dispenser of claim 33, wherein the nozzle comprises a first nozzle portion and a second nozzle portion separate from the first nozzle portion, and wherein the first nozzle portion and the second nozzle portion each define a portion of the orifice.

39. The cutlery dispenser of claim 38, wherein the first nozzle portion and the second nozzle portion are configured to separate to allow the cutlery packets to be dispensed therebetween.

40. The cutlery dispenser of claim 38, wherein the first nozzle portion is supported by the lid and configured to move therewith when the case is moved from the closed configuration into the open configuration, and wherein the second nozzle portion is supported by the base and configured to remain stationary therewith when the case is moved from the closed configuration into the open configuration.

41. The cutlery dispenser of claim 33, wherein the nozzle is configured such that a pulling force required to pull one of the cutlery packets through the orifice is greater than a tensile force required to separate adjacent cutlery packets.

42. The cutlery dispenser of claim 33, wherein the nozzle has a unitary construction.

43. The cutlery dispenser of claim 42, wherein the nozzle is supported by the lid and configured to move therewith when the case is moved from the closed configuration into the open configuration.

44. The cutlery dispenser of claim 42, wherein the nozzle is supported by the base and configured to remain stationary therewith when the case is moved from the closed configuration into the open configuration.

45. The cutlery dispenser of claim 33, wherein a majority of the cutlery packets are disposed in a stack within a lower portion of the case, and wherein the dispenser defines a headspace between a top of the stack and the nozzle.

46. The cutlery dispenser of claim 45, wherein each cutlery packet comprises a pouch and a cutlery utensil disposed within the pouch, and wherein a height of the headspace is greater than half of a length of the cutlery utensil.

47. The cutlery dispenser of claim 45, wherein each cutlery packet comprises a pouch and a cutlery utensil disposed within the pouch, and wherein a height of the headspace is approximately equal to a length of the cutlery utensil.

48. The cutlery dispenser of claim 33, wherein each cutlery packet comprises a pouch and a cutlery utensil disposed within the pouch, wherein the cutlery utensil comprises a head and a handle, and wherein the nozzle is configured such that a pulling force required to pull the head through the orifice is greater than a tensile force required to separate adjacent cutlery packets.

49. The cutlery dispenser of claim 48, wherein the nozzle is configured such that a pulling force required to pull the handle through the orifice is less than the tensile force required to separate adjacent cutlery packets.

* * * * *